US011788298B2

(12) United States Patent
Bliss et al.

(10) Patent No.: US 11,788,298 B2
(45) Date of Patent: Oct. 17, 2023

(54) RETRACTABLE AWNING ASSEMBLIES AND METHODS FOR PACKAGING THE SAME

(71) Applicant: Glen Raven, Inc., Glen Raven, NC (US)

(72) Inventors: Andrew Bliss, Atlanta, GA (US); Trey Davenport, Gillsville, GA (US); Alexandra Hart, Baltimore, MD (US); Sivan Postelnik, Glen Raven, NC (US)

(73) Assignee: Glen Raven, Inc., Glen Raven, NC (US)

( * ) Notice: Subject to any disclaimer, the term of this patent is extended or adjusted under 35 U.S.C. 154(b) by 657 days.

(21) Appl. No.: 16/827,773

(22) Filed: Mar. 24, 2020

(65) Prior Publication Data

US 2020/0308841 A1 Oct. 1, 2020

Related U.S. Application Data

(60) Provisional application No. 62/826,499, filed on Mar. 29, 2019.

(51) Int. Cl.
*E04F 10/06* (2006.01)

(52) U.S. Cl.
CPC ..... *E04F 10/0611* (2013.01); *E04F 10/0633* (2013.01); *E04F 10/0644* (2013.01); *E04F 10/0685* (2013.01); *E04F 10/0692* (2013.01)

(58) Field of Classification Search
CPC ..... E04F 10/0611; E04F 10/0633; E04F 10/0644; E04F 10/0685; E04F 10/0692; E04F 10/0648; E04F 10/0662; E04F 10/0651; E04F 10/0618; E06B 9/17046; E06B 9/44
See application file for complete search history.

(56) References Cited

U.S. PATENT DOCUMENTS 1,742,234 A * 1/1930 Clifton ..... E04F 10/0618 160/80
2,620,025 A * 12/1952 Powers ..... E04F 10/02 403/104
3,779,302 A * 12/1973 Akers ..... B60P 3/343 160/68
6,029,732 A * 2/2000 Malott ..... E04F 10/0648 160/67
6,957,679 B2 * 10/2005 Powell ..... E04F 10/06 160/64
7,188,889 B2 * 3/2007 Wagner ..... B60P 3/343 135/88.11
9,834,952 B1 * 12/2017 Meyers ..... E04F 10/0614
2013/0126104 A1 * 5/2013 Weber ..... E04F 10/0618 160/79
2019/0010708 A1 * 1/2019 Coucke ..... E04F 10/0611

FOREIGN PATENT DOCUMENTS

EP 2108760 A3 * 11/2012 ..... E04F 10/06

* cited by examiner

*Primary Examiner* — Abe Massad
(74) *Attorney, Agent, or Firm* — Myers Bigel, P.A.

(57) ABSTRACT

The present disclosure describes a retractable awning assembly. The retractable awning assembly may include a plurality of roller tube sections, at least two torsion bar sections, a pair of spring-loaded arms, a fabric cover, a plurality of front bar sections, a pair of end caps, a plurality of mounting brackets, and a plurality of hood sections. Methods of assembling the same are provided.

9 Claims, 19 Drawing Sheets

RETRACTABLE AWNING ASSEMBLIES AND METHODS FOR PACKAGING THE SAME

RELATED APPLICATION(S)

The present application claims priority from and the benefit of U.S. Provisional Application Ser. No. 62/826,499, filed Mar. 29, 2019, the disclosure of which is hereby incorporated herein in its entirety.

FIELD OF THE INVENTION

The invention relates to retractable awning assemblies and methods for packaging the same.

BACKGROUND OF THE INVENTION

An awning can change the environment of an outdoor area, adding value to the space by protecting it from uncomfortable light, UV radiation, and light rain. Although many designs and styles of awnings exist, their cumbersome shape and complexity makes them difficult to transport and install from the standpoint of the average consumer. Current awning designs and assemblies can limit the availability such that they must be ordered from the manufacturer, specially delivered, and professionally installed. Thus, alternative awning assemblies that would allow a user to purchase, transport, and install the awning himself or herself, cutting down on the complication and cost of the transaction, and giving the owner more autonomy over the modification to their space, are desired.

SUMMARY OF THE INVENTION

A first aspect of the present invention is directed to a retractable awning assembly. The retractable awning assembly may include a retractable awning, a plurality of mounting brackets, and a hood having a plurality of hood sections. The retractable awning may include a roller tube having a plurality of roller tube sections, at least two torsion bar sections, each torsion bar section attached to a respective roller tube section, a pair of spring-loaded arms, each spring-loaded arm attached to a respective torsion bar section, a front bar having a plurality of front bar sections, the front bar attached to the pair of spring-loaded arms, and a fabric cover having a front end and a back end, wherein the front end of the fabric cover is attached to the front bar and the back end of the fabric cover is attached to the roller tube. Each roller tube section is configured to be connected together by keyed splices that allow one roller tube section to be inserted into another roller tube section and configured to be secured to one another by spring snap button features. Each front bar section is configured to be connected together by keyed splices that allow one front bar section to be inserted into another front bar section and configured to be secured to one another by spring snap button features. The plurality of mounting brackets may be configured to secure the retractable awning to a mounting structure. The hood may be attached to the plurality of mounting brackets and reside above the retractable awning.

Another aspect of the present invention is directed to a method of assembling a retractable awning. The method may include providing a disassembled retractable awning assembly including a plurality of roller tube sections, at least two torsion bar sections, each coupled to a respective roller tube section, a pair of spring-loaded arms, a fabric cover having a front end and a back end, a plurality of front bar sections, a plurality of mounting brackets, and a plurality of hood sections. The method may further include connecting the plurality of roller tube sections together by inserting keyed splices of one roller tube section into another roller tube section until a spring snap button feature secures each section together to form a roller tube subassembly, attaching and securing each spring-loaded arm to a respective torsion bar section, attaching the back end of the fabric cover to the roller tube subassembly, rolling the fabric cover onto roller tube subassembly, connecting the plurality of front bar sections together by inserting keyed splices of one front bar section into another front bar section until a spring snap button feature secures each section together to form a front bar subassembly, attaching and securing the spring-loaded arms to the front bar subassembly, attaching the front end of the fabric cover to the front bar subassembly, securing the plurality of mounting brackets to a mounting structure, attaching and securing each of the at least two torsion bar sections to a respective mounting bracket, connecting and securing the plurality of hood sections together to form a hood, and attaching and securing the hood to each mounting bracket.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim and/or file any new claim accordingly, including the right to be able to amend any originally filed claim to depend from and/or incorporate any feature of any other claim or claims although not originally claimed in that manner. These and other objects and/or aspects of the present invention are explained in detail in the specification set forth below. Further features, advantages and details of the present invention will be appreciated by those of ordinary skill in the art from a reading of the figures and the detailed description of the preferred embodiments that follow, such description being merely illustrative of the present invention.

BRIEF DESCRIPTION OF THE DRAWINGS

FIG. 10C is a top schematic view of the roller tube and front bar of the retractable awning assembly of FIG. 1.

DETAILED DESCRIPTION OF THE INVENTION

Figure 1:
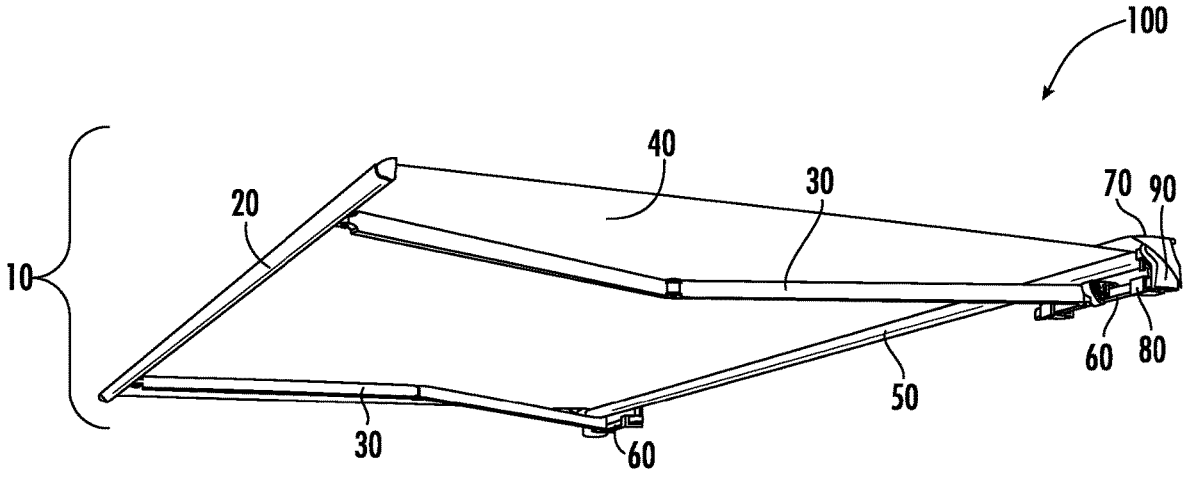
FIG. 1 is bottom perspective view of a retractable awning assembly, when extended/opened, according to embodiments of the present invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

In the figures, certain layers, components or features may be exaggerated for clarity, and broken lines illustrate optional features or operations unless specified otherwise. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention. The sequence of operations (or steps) is not limited to the order presented in the claims or figures unless specifically indicated otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Referring now to the figures, a retractable awning assembly 100 according to some embodiments of the present invention is illustrated in FIGS. 1-12. First referring to FIG. 1 and FIG. 2, according to some embodiments of the present invention, a retractable awning assembly 100 may include a retractable awning 10, a plurality of mounting brackets 80, and a hood 70. The retractable awning 10 may include a roller tube 50, at least two torsion bar sections 60, a pair of spring-loaded arms 30, a front bar 20, and a fabric cover 40. The roller tube 50, torsion bar sections 60, spring-loaded arms 30 and front bar 20 form the frame of the retractable awning 10.

Figure 2:
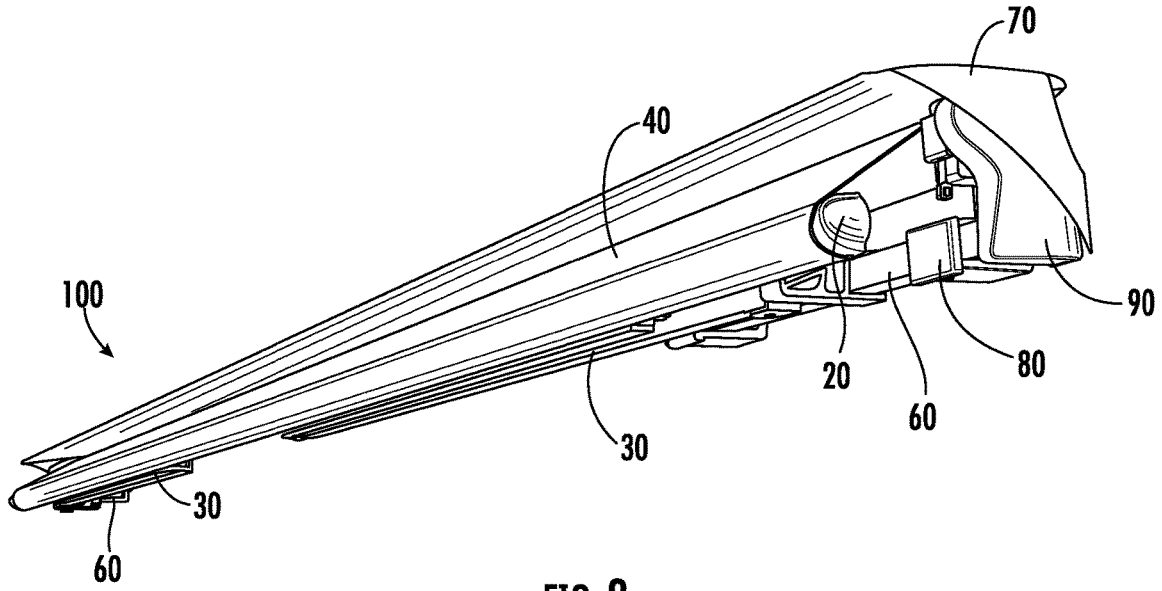
FIG. 2 is a bottom perspective view of the retractable awning assembly of FIG. 1, when retracted/closed.
Figure 10A:
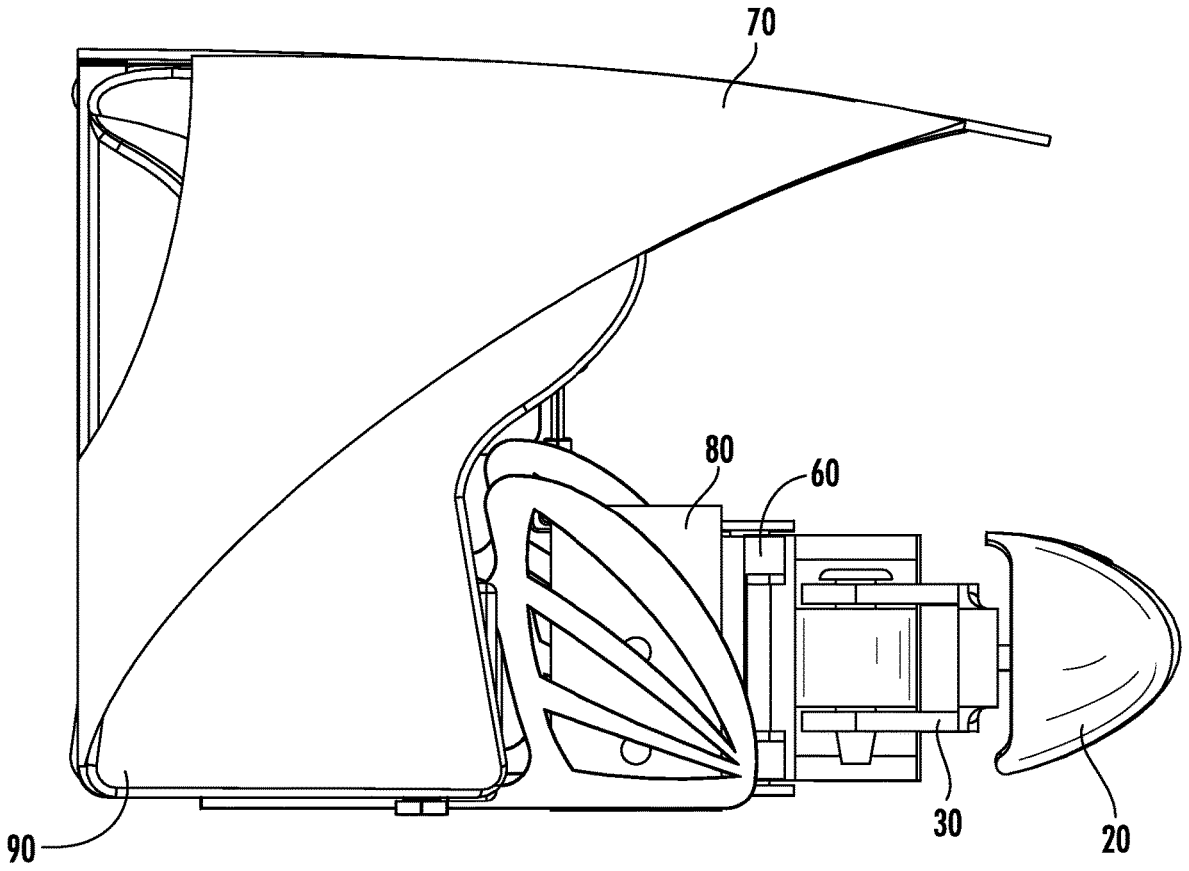
FIG. 10A is a side schematic view of the retractable awning assembly of FIG. 1, when retracted/closed.
Figures 10B, 10D:
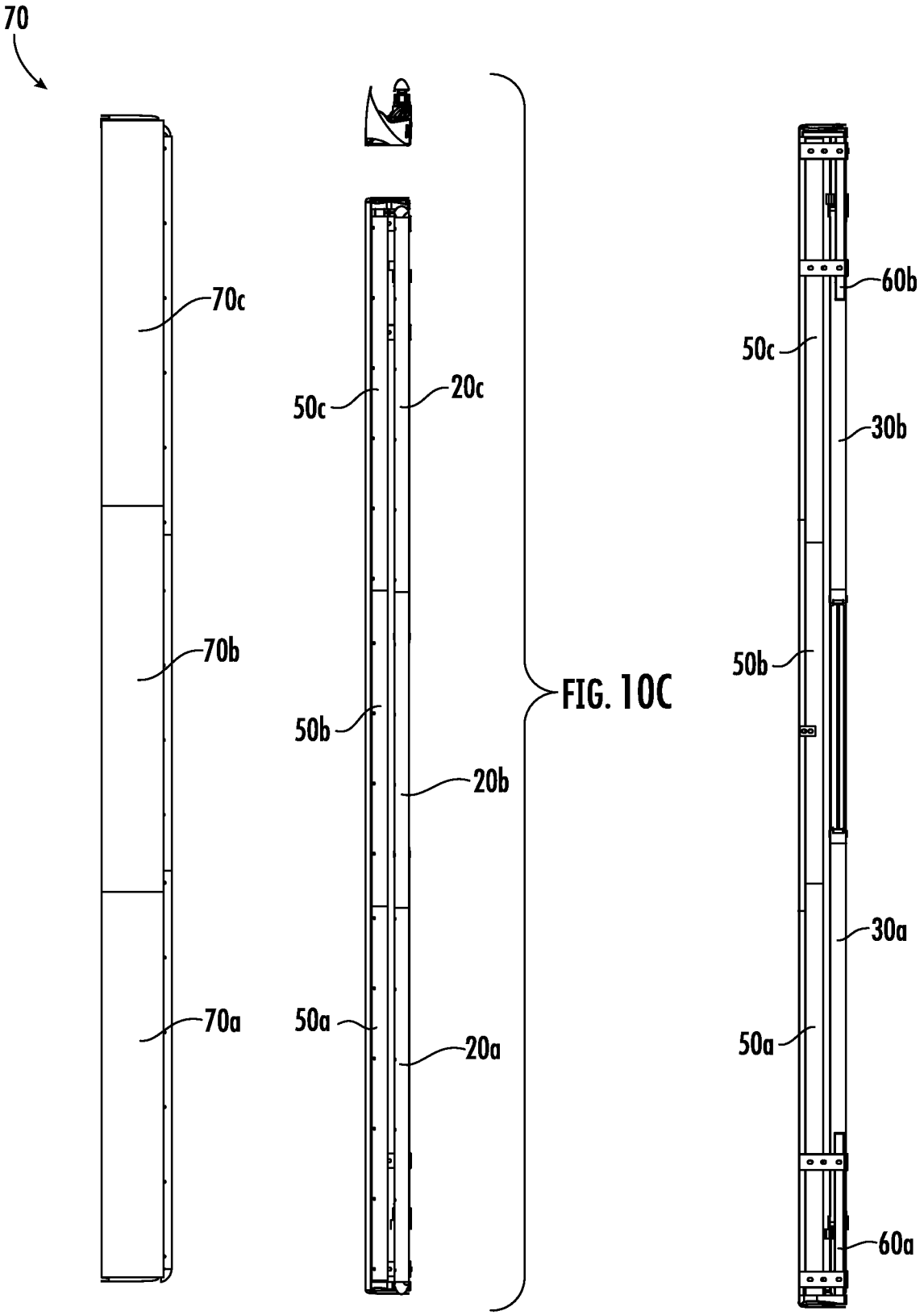
FIG. 10B is a top schematic view of the hood of the retractable awning assembly of FIG. 1.
FIG. 10D is a top schematic view of the roller tube, torsion bar sections, and spring-loaded arms of the retractable awning assembly of FIG. 1.
Figure 10E:
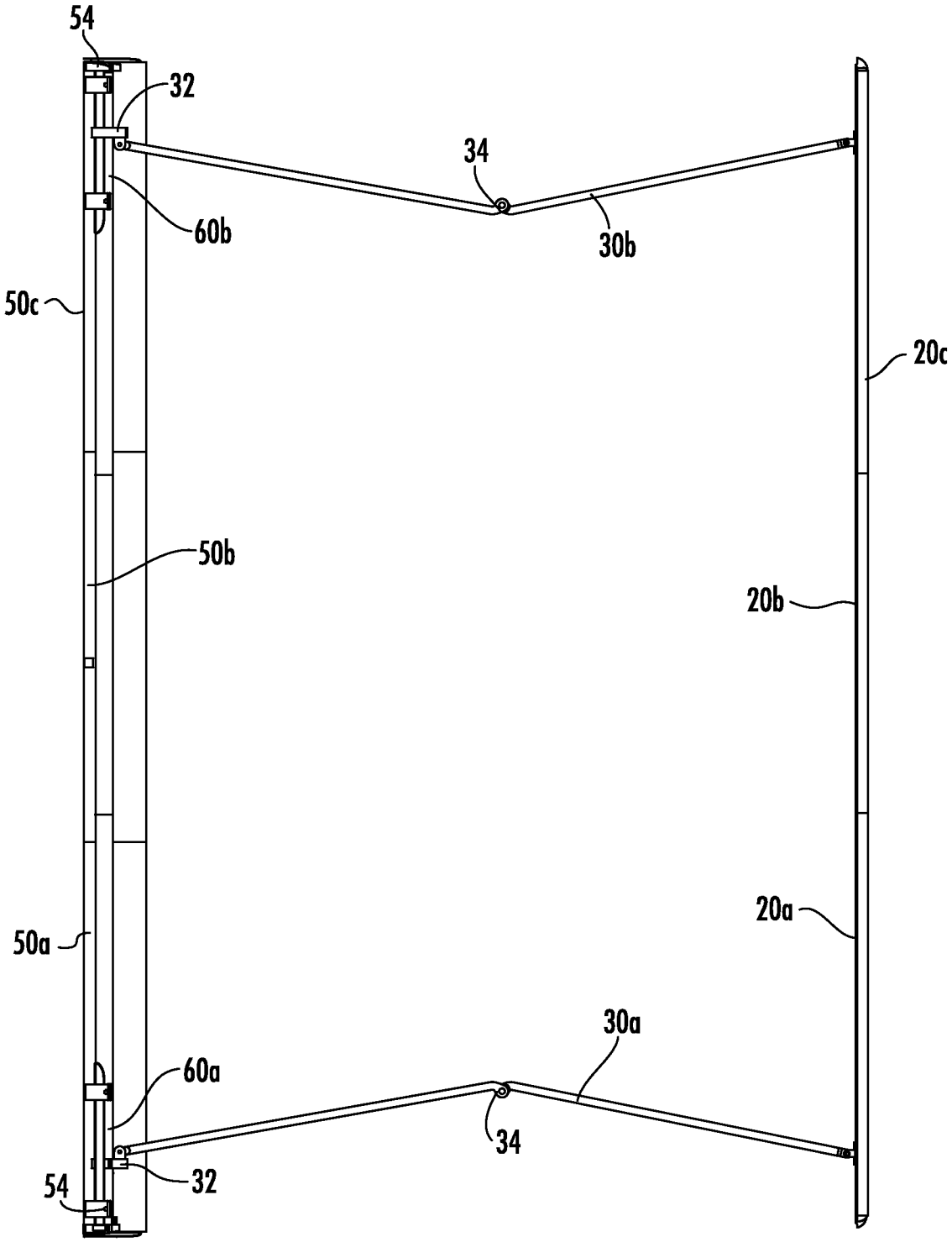
FIG. 10E is a top schematic view of the retractable awning assembly of FIG. 1, when expanded/opened.

FIG. 1 shows the retractable awning assembly 100 in an expanded or open position (i.e., when the retractable awing 10 is in use) (see also, e.g., FIG. 10E which shows a top schematic view of the retractable awning 10 in an expanded/open position). FIG. 2 shows the retractable awning assembly 100 in a retracted or closed position (i.e., when the retractable awning 10 is not in use) (see also, e.g., FIG. 10A which shows a side schematic view of the retractable awning 10 in a retracted/closed position).

Figure 3:
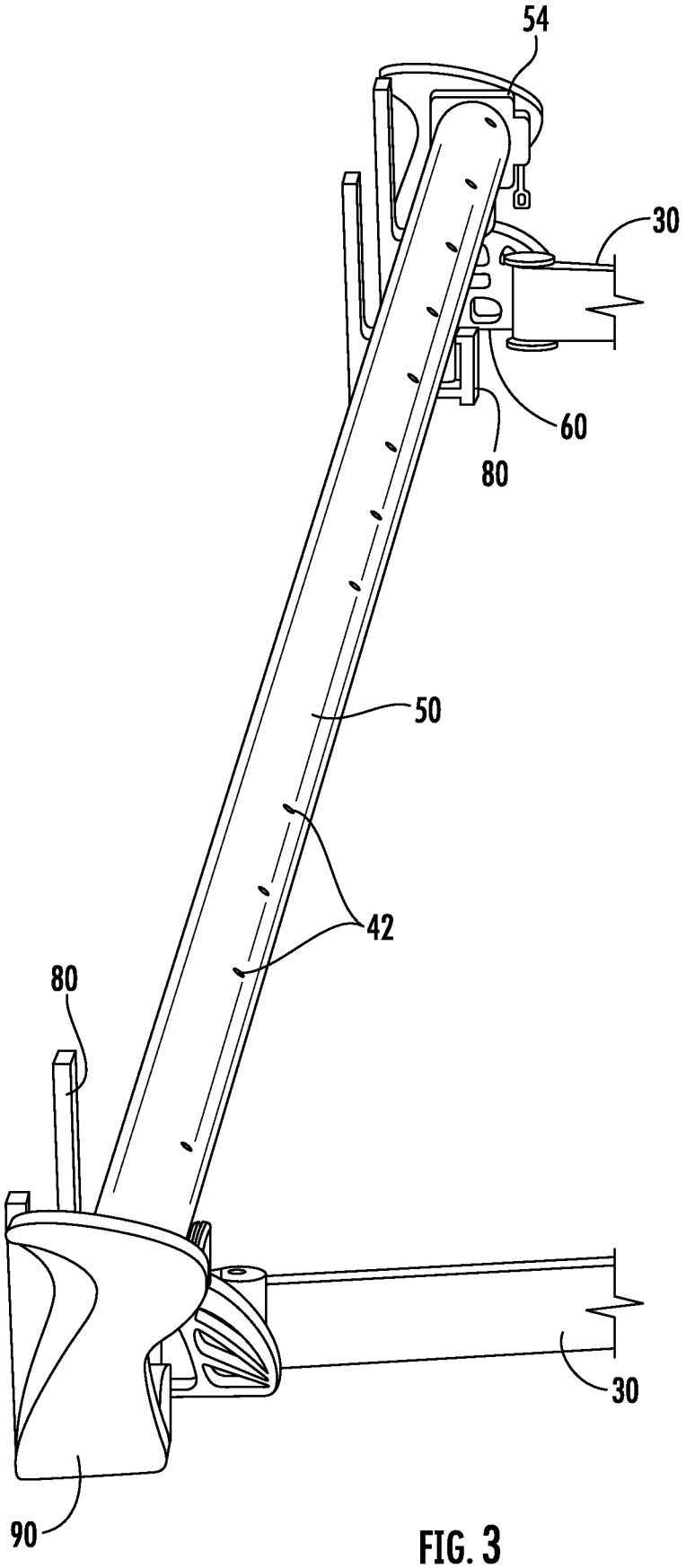
FIG. 3 is an enlarged top perspective view of a roller tube of the retractable awning assembly of FIG. 1.

FIG. 3 shows an enlarged top perspective view of the roller tube 50. In some embodiments, the roller tube 50 may have a plurality of roller tube sections 50*a*, 50*b*, 50*c* (see also, e.g., FIGS. 10C-10D, FIGS. 12B-12E). For example, in some embodiments, the roller tube 50 may have one, two, three, or more roller tube sections 50*a-c* (i.e., roller tube subassembly). In embodiments having multiple roller tube sections 50*a-c*, the roller tube sections 50*a-c* may be mounted to one another with keyed splices 52 that insert from one roller tube section 50*a-c* to another roller tube section 50*a-c* (see, e.g., FIG. 12C). In some embodiments, the splicing 52 secures itself into place with a spring steel snap button preventing the three sections 50*a-c* from sliding apart. In some embodiments, roller tube sections 50*a-c* each may comprise corresponding threads and may be mounted to one another by screwing each roller tube section 50*a-c* together.

In some embodiments, the roller tube 50 may have a length in a range of about 10 feet to about 20 feet. For example, in some embodiments, the roller tube may have a length of about 16 feet. In some embodiments, the roller tube 50 may be formed from aluminum, aluminum alloy or other similar lightweight metals. In some embodiments, the roller tube 50 may be formed from carbon fiber-reinforced polymer. In general, the roller tube 50 is cylindrical in shape, which allows a fabric cover 40 to wrap around the roller tube 50 when the retractable awning 10 closes (or retracts).

Figure 12A:
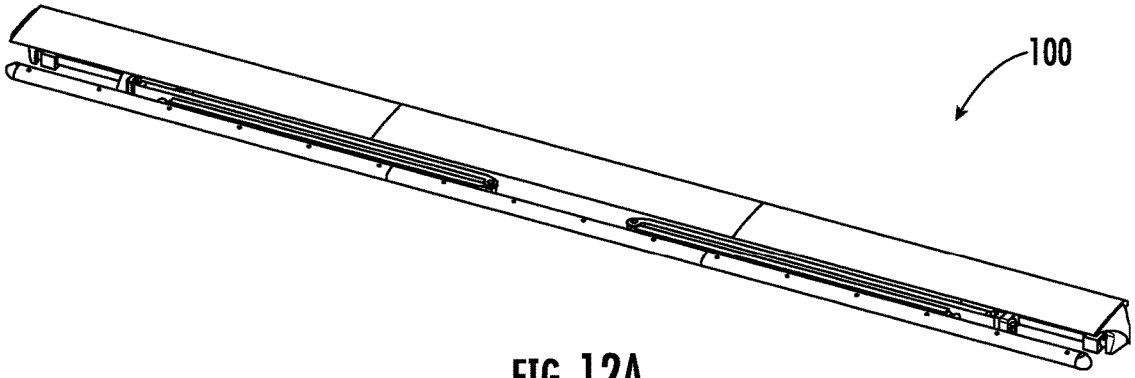
FIGS. 12A-12Q illustrate steps for an exemplary method of assembling a retractable awning assembly according to embodiments of the present invention.
Figure 12B:
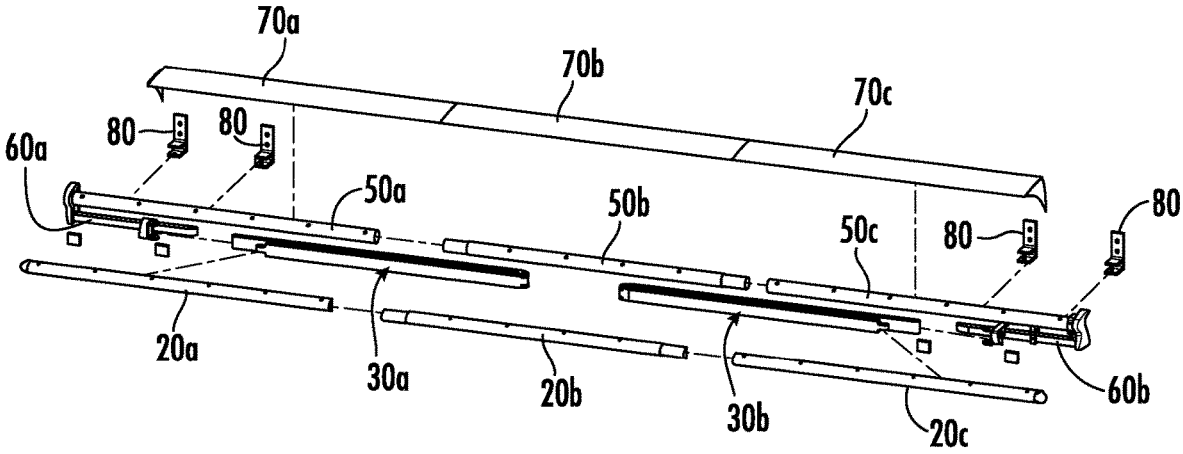
Figure 12C:
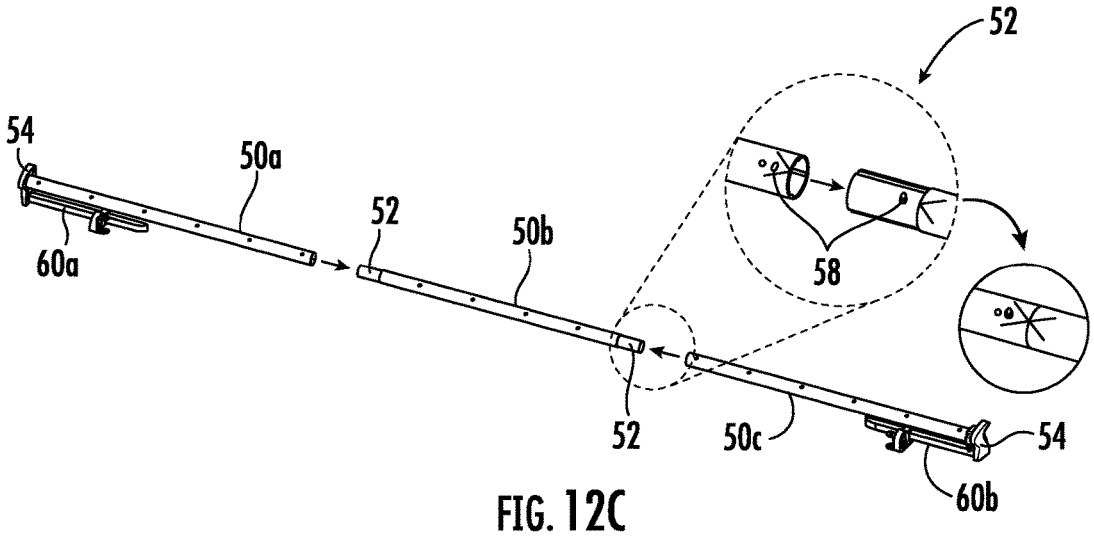
Figure 12D:
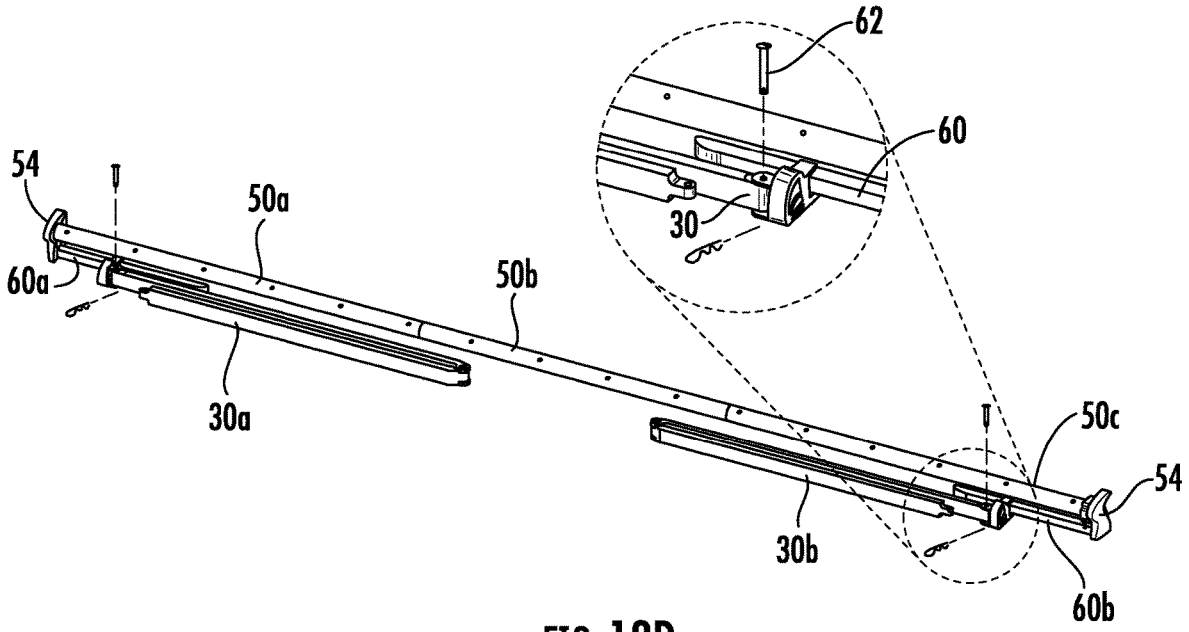
Figure 12E:
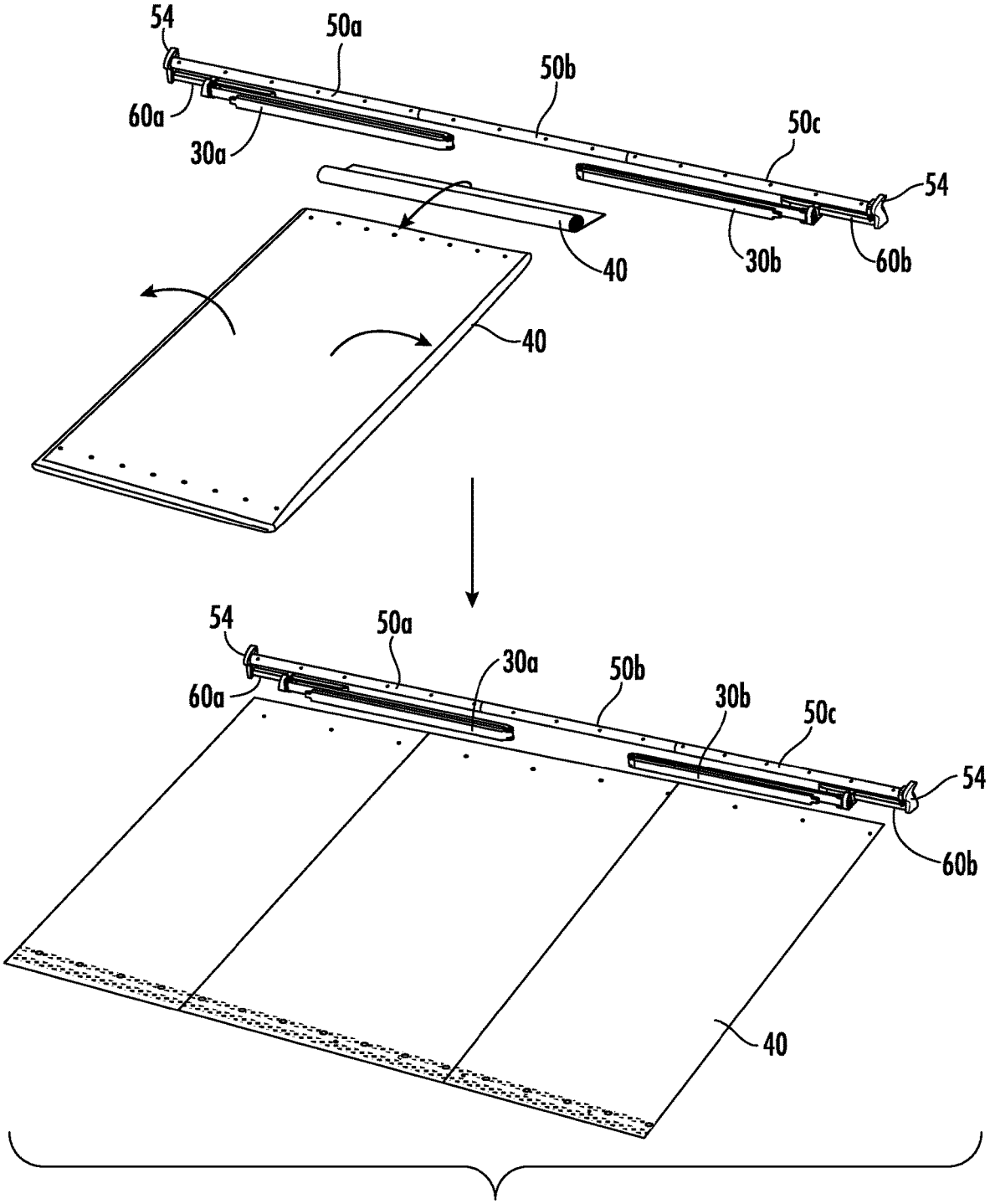
Figure 12F:
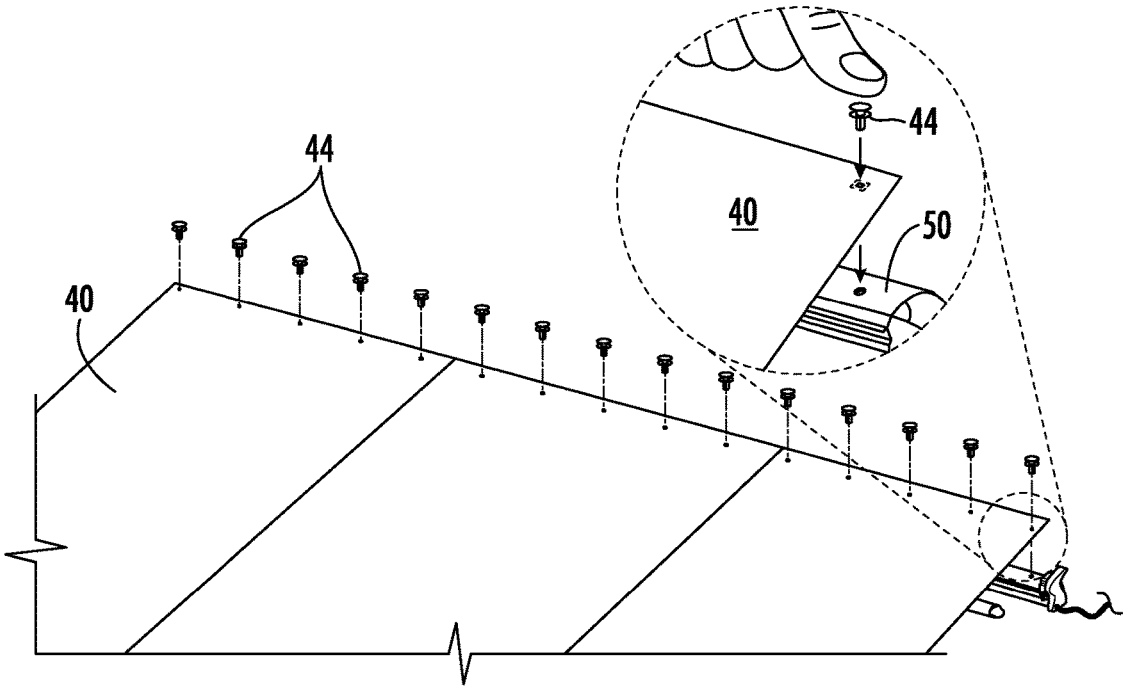
Figure 12G:
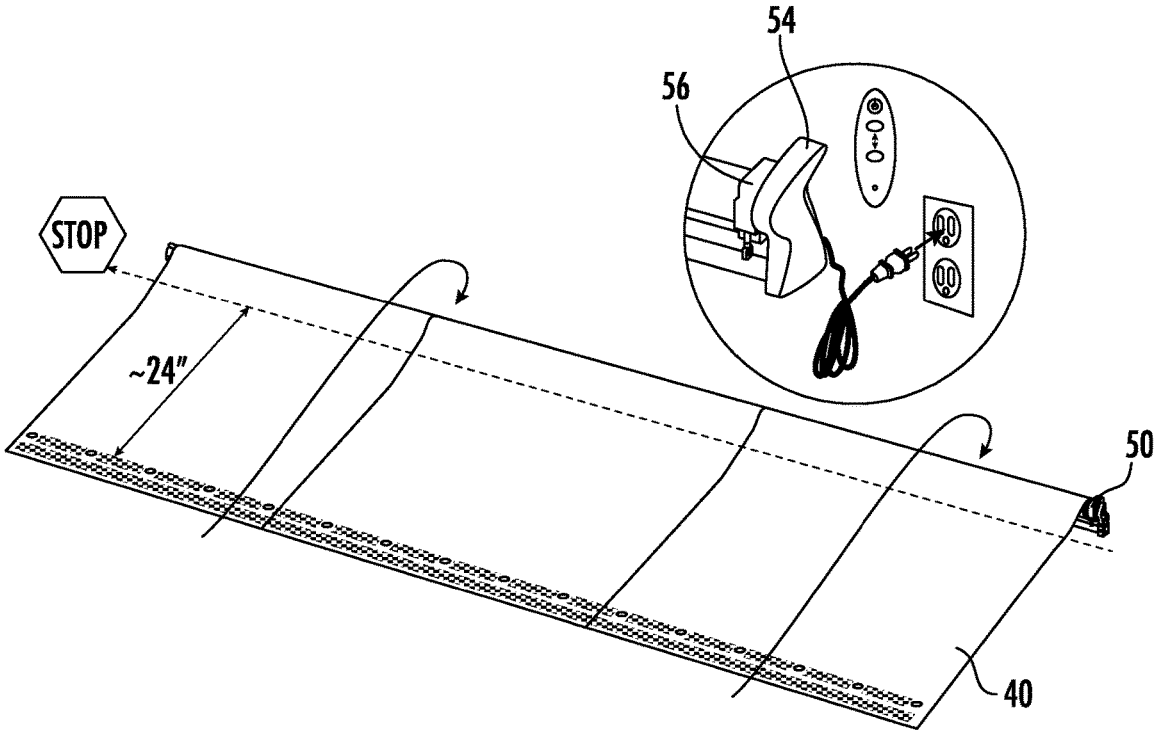
Figure 12H:
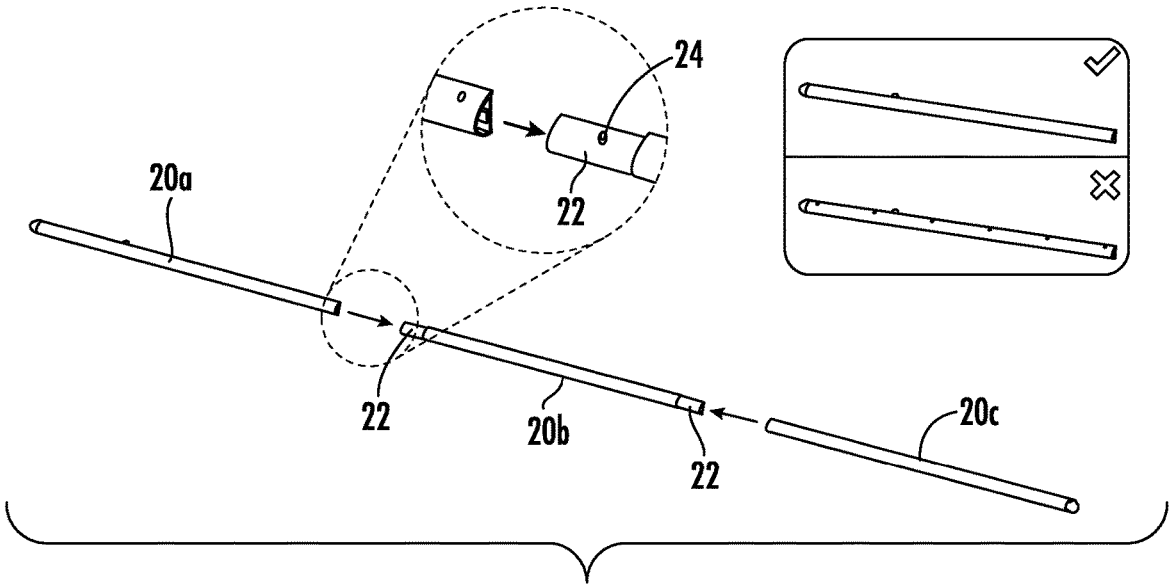
Figure 12I:
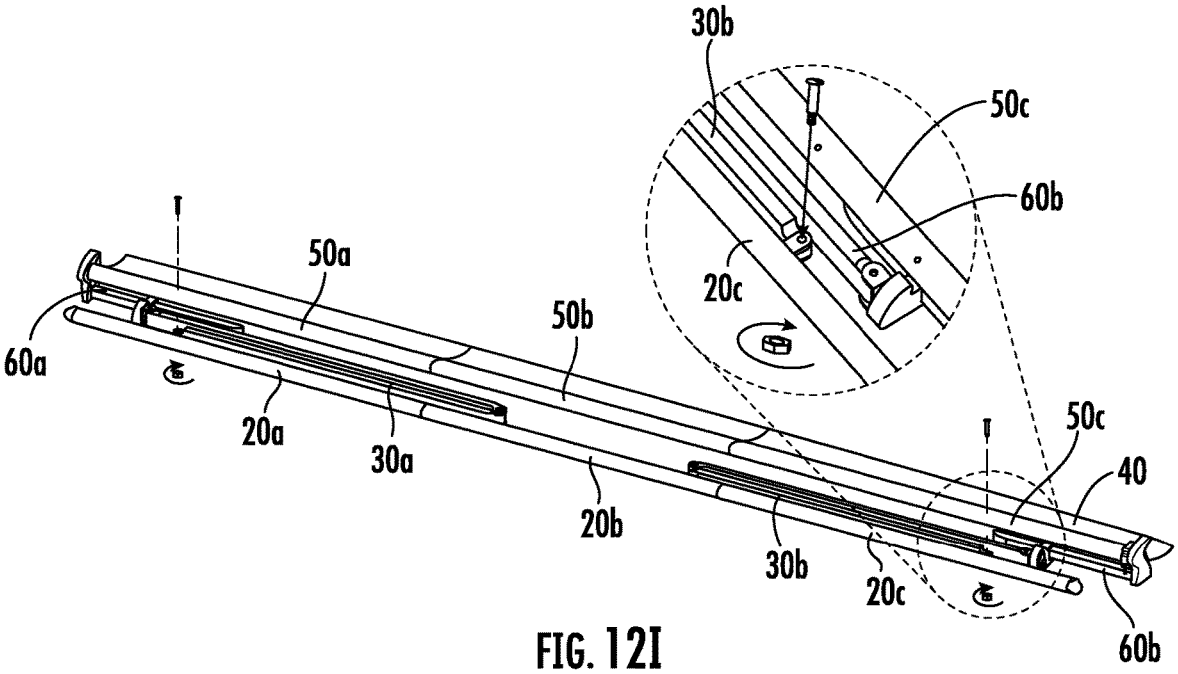

The roller tube 50 of the present invention may be supported on the ends by roller tube bearing brackets 54, which hold the bearings on which the roller tube 50 rotates attached to the torsion bar sections 60*a*, 60*b* for support. A drive motor 56 is attached adjacent one of the bearing brackets 54 (FIG. 12G). The entire roller tube 50 must be manipulated by the torque of the drive motor 56 located on one side of the retractable awning assembly 100. This torque transference is accomplished by the keyed splices 52 through meshing teeth (not shown) (FIG. 12C). The meshing teeth are keyed in a way such that the splice 52 may be inserted into the mating roller tube section 50*a-c* in only one angle of orientation (the orientation which maintains fabric holes 42 in alignment).

A key consideration for the assembly of the roller tube sections 50*a-c* is the tolerance of the splice 52 outside diameter and the roller tube section 50*a-c* outside diameter. A splice 52 connection with low deflection requires a tight tolerance; however, loose tolerance creates an easier user-assembly and better handles potential debris in the connection. In some embodiments, the roller tube sections 50*a-c* may have visual alignment arrows or lines to assist a user to easily see when the mating roller tube sections 50*a-c* of roller tube 50 are correctly angularly oriented. Each of the outer roller tube sections 50*a*, 50*c* may be pre-attached to the roller tube bearing brackets 54: one with a simple rotating bearing bracket 54, and the other with the drive motor 56 nested inside and mounted to the bearing bracket 54. Once the roller tube sections 50*a-c* of the roller tube 50 have been inserted together, the roller tube sections 50*a-c* are automatically secured with a snap button 58 and may be additionally secured with self-tapping screws or other fastening mechanism. Once assembled, the roller tube 50 can be attached to the fabric cover 40 using plastic push-in rivets 44 or similar fastening mechanism (see, e.g., FIG. 12F).

Figure 4:
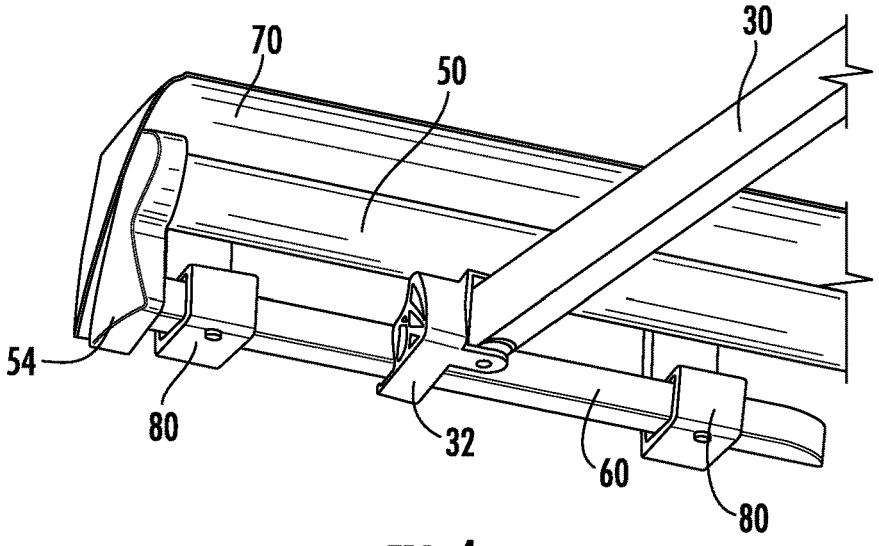
FIG. 4 is an enlarged bottom perspective view of a torsion bar section of the retractable awning assembly of FIG. 1.

FIG. 4 shows an enlarged bottom perspective view of a torsion bar section 60 of the retractable awning assembly 100. In some embodiments, for example, as shown in FIG. 10D, each torsion bar section 60*a*, 60*b* is attached to a respective roller tube section, e.g., end roller tube sections 50*a*, 50*c*. In some embodiments, each torsion bar section 60*a*, 60*b* may be formed from a hollow aluminum or aluminum alloy tube. The torsion bar sections 60*a*, 60*b* may be formed from other similar lightweight metals. In some embodiments, the torsion bar sections 60*a*, 60*b* may be formed from carbon fiber-reinforced polymer. In general, the torsion bar sections 60*a*, 60*b* have a square cross-section. However, in some embodiments, the torsions bars 60*a*, 60*b* may have other cross-sectional shapes, such as, for example, rectangular, circular, hexagonal, etc. The torsion bar sections 60*a*, 60*b* function as the part of frame of the retractable awning 10 supporting not only the weight of the entire retractable awning assembly 100, but also the rotational moment of inertia created by the outstretched spring-loaded arms 30 of the retractable awning 10 when open (i.e., extended). The torsion bar sections 60*a*, 60*b* help prevent the retractable awning 10 from turning and/or twisting.

In some embodiments, the torsion bar sections 60*a*, 60*b* may each have a length in the range of about 10 inches to about 30 inches or more. For example, in some embodiments, the torsion bar sections 60*a*, 60*b* each have a length of about 24 inches (i.e., about 2 feet). The ends of each torsion bar section 60*a*, 60*b* are attached to the roller tube 50 by the roller tube bearing brackets 54 and the center of each torsion bar section 60*a*, 60*b* is attached to the spring-loaded arm brackets 32. In some embodiments, the roller tube 50 may be pre-attached by its bearing brackets 54 to the torsion bar sections 60*a*, 60*b* during manufacturing assembly and packaged this way. The spring-loaded arm brackets 32 may also be pre-attached to the torsion bar sections 60*a*, 60*b*. During the user assembly process, the spring-loaded arms 30*a*, 30*b* are attached to the spring-loaded arm brackets 32 using pin connections or a similar fastening mechanism which may increase the efficiency of assembly time for the user as well as decrease room for error during assembly.

Figure 5:
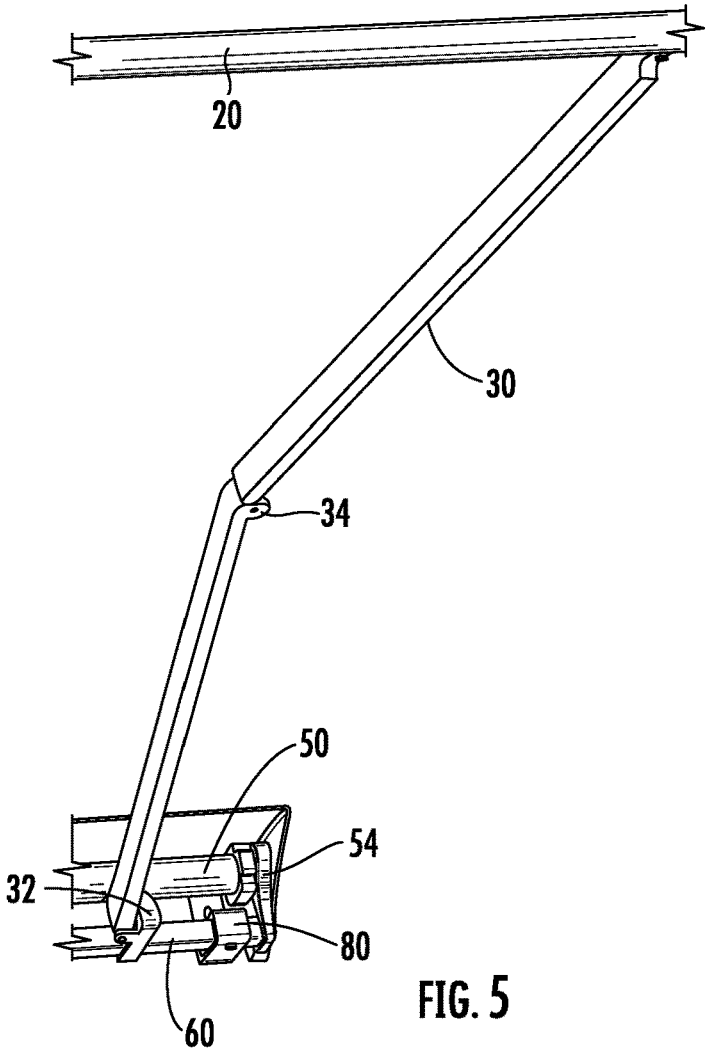
FIG. 5 is an enlarged bottom perspective view of a spring-loaded arm of the retractable awning assembly of FIG. 1.

FIG. 5 shows an enlarged bottom perspective view of one of the spring-loaded arms 30 of the retractable awning assembly 100. In some embodiments, the spring-loaded arms 30*a*, 30*b* may be formed from aluminum or aluminum alloy tubes that are connected by a center hinge point 34. The spring-loaded arms 30*a*, 30*b* may be formed from other similar lightweight metals. In some embodiments, the spring-loaded arms 30*a*, 30*b* may be formed from carbon fiber-reinforced polymer. The spring-loaded arms 30*a*, 30*b* may be internally loaded by a steel cable under spring tension giving them a persistent opening force. The opening force of these spring-loaded arms 30*a*, 30*b* performs much, if not all, of the work of opening the retractable awning 10. In some embodiments, the spring-loaded arms 30*a*, 30*b* may internally include a linear damper to limit the speed with which the spring-loaded arms 30*a*, 30*b* move.

In some embodiments, each spring-loaded arm 30*a*, 30*b* is attached to a respective torsion bar section 60*a*, 60*b* (see, e.g., FIG. 4, FIG. 5, FIG. 10D, FIG. 10E, FIG. 12D). The spring-loaded arms 30*a*, 30*b* may be attached and locked to the torsion bar sections 60*a*, 60*b* via a locking pin 62 (FIG. 12D) The other attachment point for each spring-loaded arm 30*a*, 30*b* is to the front bar 20 (see, e.g., FIG. 5, FIG. 6, FIG. 10E). The length of the spring-loaded arms 30*a*, 30*b* defines the projection distance of the retractable awning 10. In some embodiments, the spring-loaded arms 30*a*, 30*b* may have an extended length in a range of about 8 feet to about 12 feet, and when closed, a length in the range of about 3 feet to about 6 feet. For example, in some embodiments, the spring-loaded arms 30*a*, 30*b* have an extended length of about 10 feet, and when closed, a length of about 5 feet.

Figure 6:
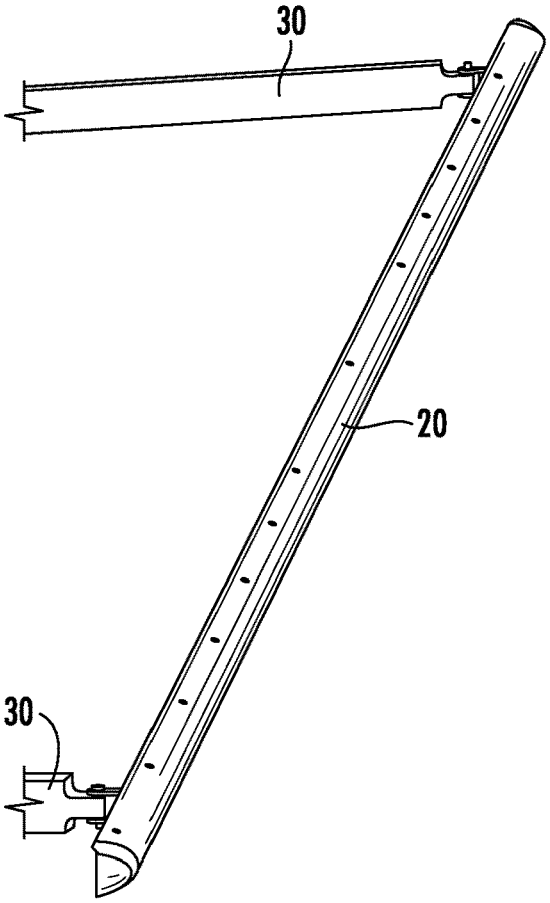
FIG. 6 is an enlarged top perspective view of a front bar of the retractable awning assembly of FIG. 1.

FIG. 6 shows an enlarged top perspective view of a front bar 20 of the retractable awning assembly 100. In some embodiments, the front bar 20 may have a plurality of front bar sections 20*a*, 20*b*, 20*c* (see, e.g., FIG. 10C, FIG. 12B, FIG. 1211, FIG. 121). For example, in some embodiments, the front bar 12 may have one, two, three, or more front bar sections 20*a-c* (i.e., front bar subassembly). The front bar 20 functions as the part of frame of the retractable awning 10 and is attached to the pair of spring-loaded arms 30*a*, 30*b* (FIG. 121). In embodiments having multiple front bar sections 20*a-c*, the center front bar section 20*b* may be manufactured with a keyed splicing 22 on each end that protrudes out of the center tube. The splicing 22 inserts in the other sections 20*a*, 20*c* and secures itself into place with a spring steel snap button 24, thus preventing the three sections 20*a-c* from sliding apart. For extra security, and to further stabilize the front bar sections 20*a-c*, additional known fastening mechanisms may be used. Once assembled, the front bar 20 is secured to the ends of the spring-loaded arms 30*a*, 30*b*.

The front bar 20 forms the leading support edge for the fabric cover 40. In some embodiments, the front bar 20 may have a length in the range of about 10 feet to about 20 feet. For example, in some embodiments, the front bar 20 has a length of about 16 feet. In some embodiments, the front bar 20 may be formed from aluminum or aluminum alloy. The front bar 20 may be formed from other similar lightweight metals. In some embodiments, the front bar 20 may be formed from carbon fiber-reinforced polymer.

Figure 12J:
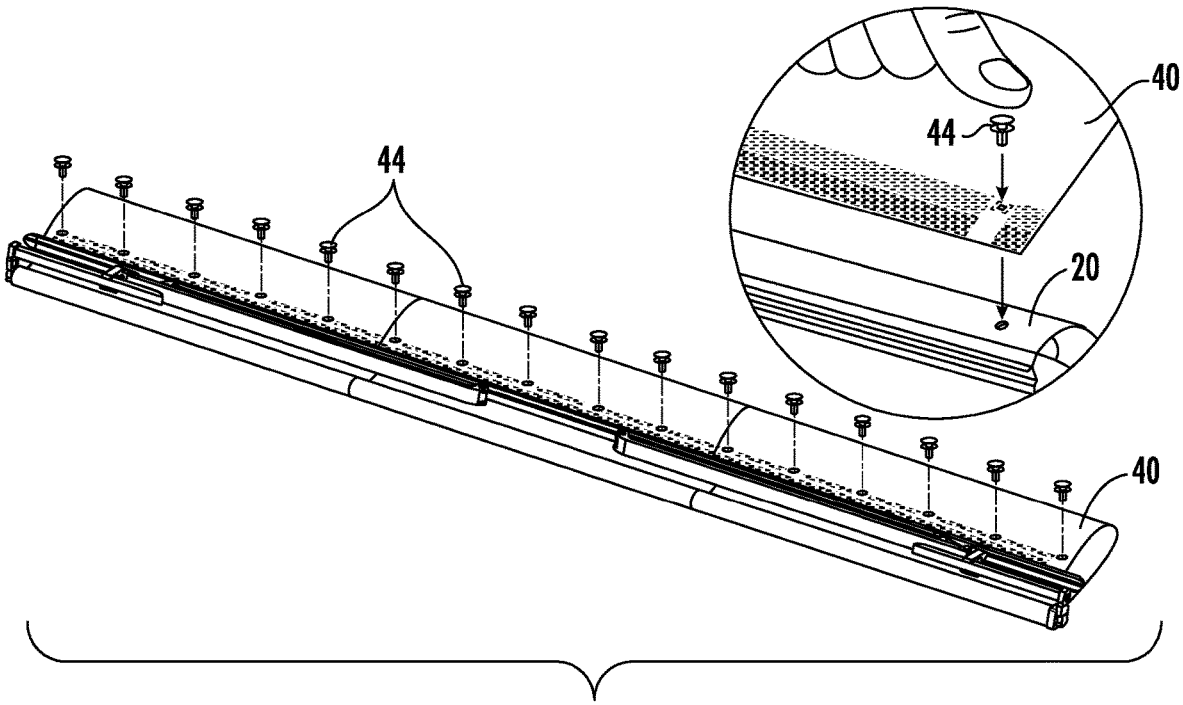
Figure 12K:
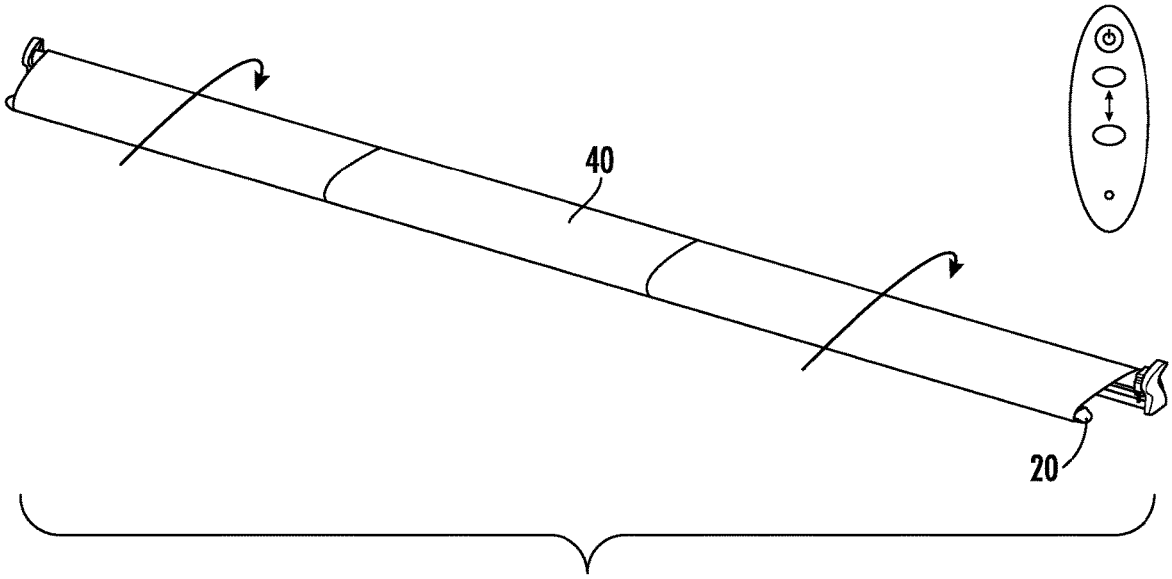
Figure 12L:
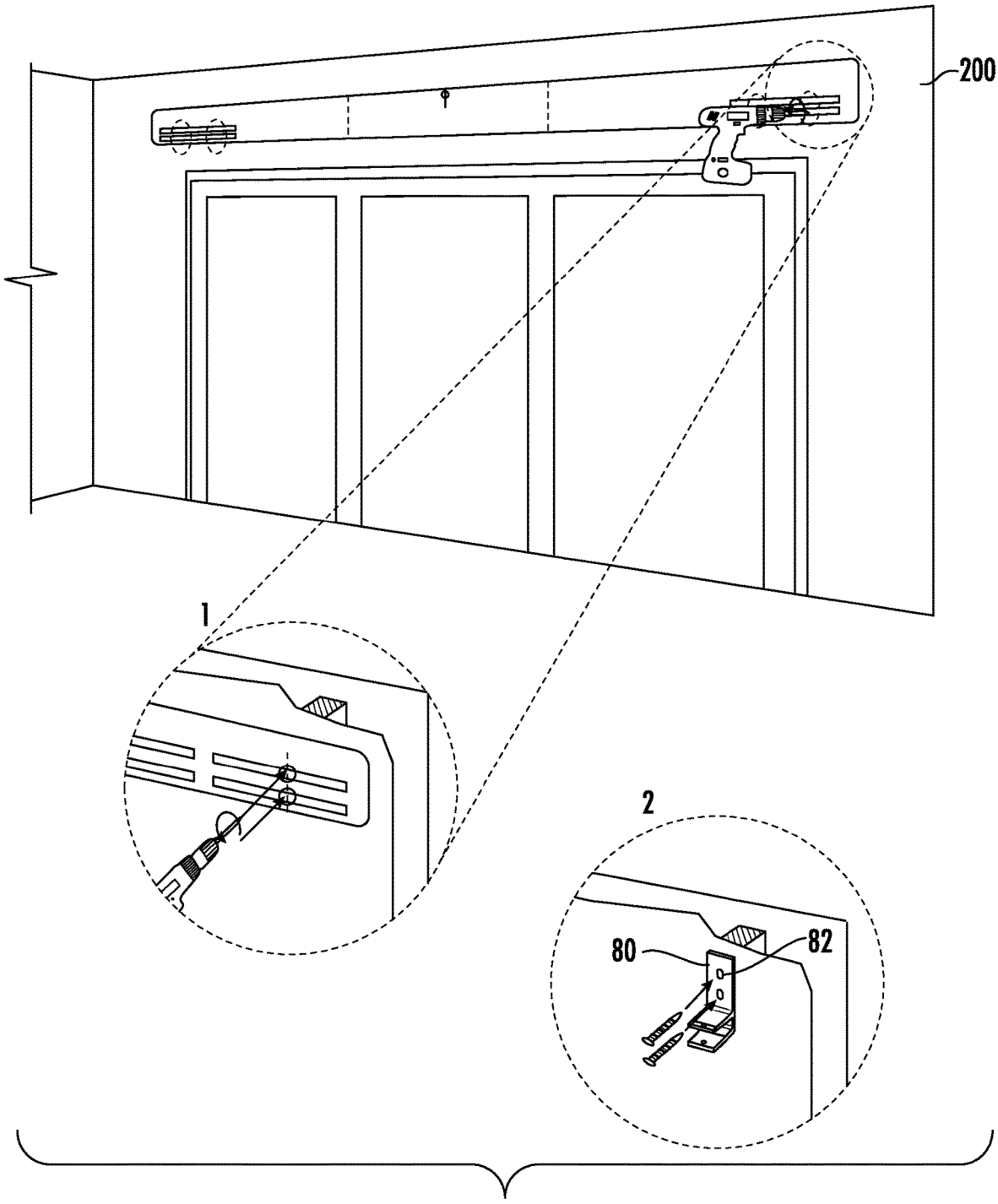
Figure 12M:
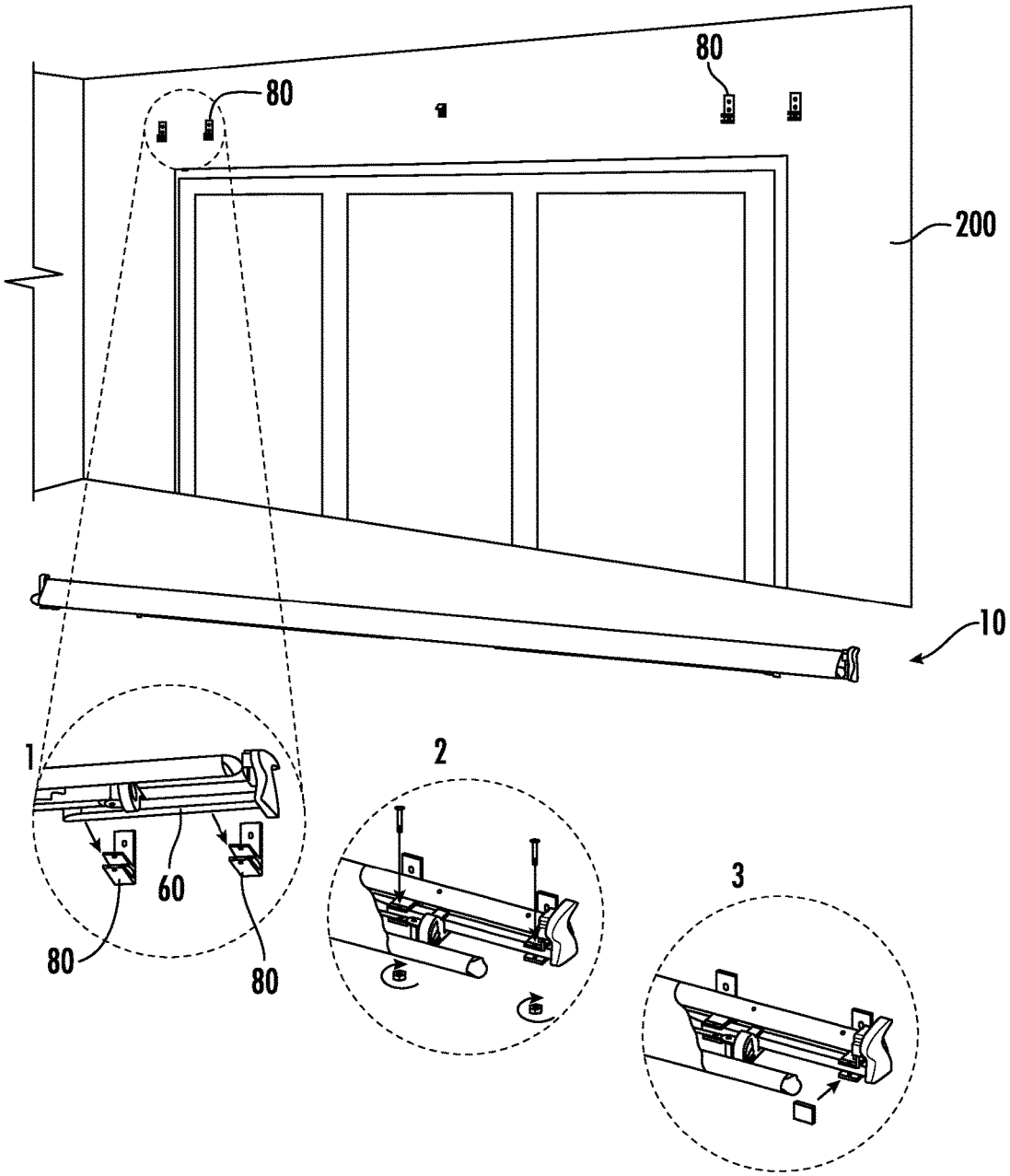

The front bar 20 is supported by the spring-loaded arms 30*a*, 30*b* and holds up the front edge of the fabric cover 40. In some embodiments, the front bar 20 may have a smooth rounded front edge (see, e.g., FIG. 6). The fabric cover 40 may curve over the front edge of the front bar 20 and attach underneath the front bar 20 with plastic push-rivets 44 or other like fastening mechanisms (FIG. 12J). In some embodiments, the push-rivets 44 can be hidden by folding the fabric cover 40 back over the pins and securing using Velcro® fasteners or other similar methods of attachment. The fabric cover 40 is pinned on the underside of the front bar 20 to avoid any moisture from entering the holes where the push-rivets 44 are holding the fabric cover 40. For aesthetic purposes, and to prevent any accumulation of debris inside the tube forming the front bar 20, the outer pieces of the front bar 20 may be sealed by plastic caps 26. Alternatively, the fabric cover 40 may be attached via a "pocket" or channel in the fabric cover 40 that receives a member attached to one of the other components of the awning.

The fabric cover 40 is what protects the deck or porch of a home from sun and rain. In some embodiments, the fabric cover 40 may have a length or about 11 feet and a width of about 15 feet. The fabric cover 40 conveys the tension force which, when pulled around the roller tube 50 by the torque of the drive motor 56, folds the lateral spring-loaded arms 30*a*, 30*b* closed. For packaging, the fabric cover 40 is folded along its lengthwise seams, then rolled into a cylinder about 4 feet long. During assembly, a user unrolls and unfolds the fabric cover 40 and attaches the width of the fabric cover 40 to the front bar 20 and the roller tube 50 by inserting nylon push-rivets 44 into button holes pre-cut in the fabric cover 40, and pre-drilled into the roller tube 50 and front bar 20 (see, e.g., FIGS. 12E-12G). As discussed above, to cover push-rivets 44 on the underside of the front bar 20, a Velcro® strip may be sewn into the edge of the fabric cover 40 on the front bar 20. Once snapped into the front bar 20, the fabric cover 40 can then be folded back over the snaps 44 and secured on with the Velcro® strip (FIG. 12J).

Figure 7:
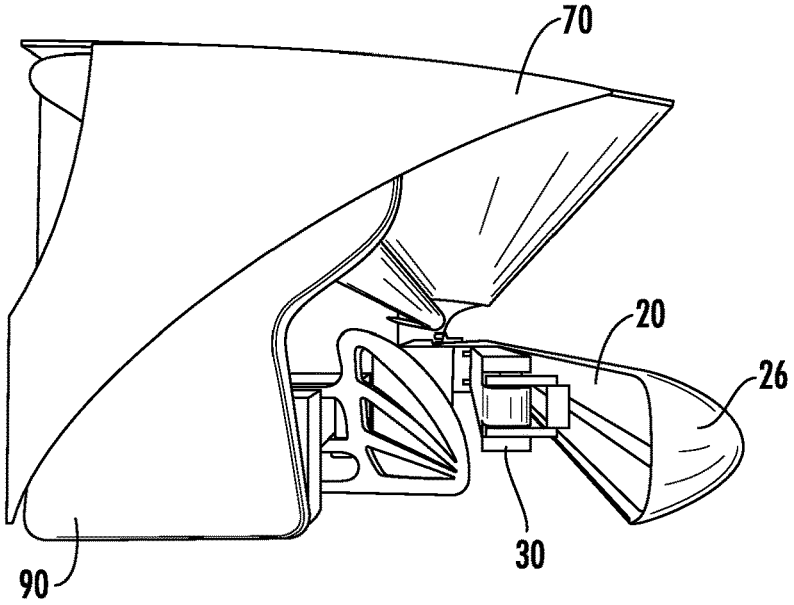
FIG. 7 is a side view of the retractable awning assembly of FIG. 1.

FIG. 7 shows a side view of the retractable awning assembly 100 in a closed/retracted position. In some embodiments, the retractable awning assembly 100 may include end caps 90. In some embodiments, the end caps 90 may be formed from plastic (e.g., polypropylene) or like material. The end caps 90 help protect the rolled fabric cover 40, bearings 54, and drive motor 56 from debris. In some embodiments, the end caps 90 may be simply snapped onto the retractable awning 10 once it has been assembled. Combined with the hood 24, the end caps 90 can help protect the retractable awning 10 when not in use.

Figure 8:
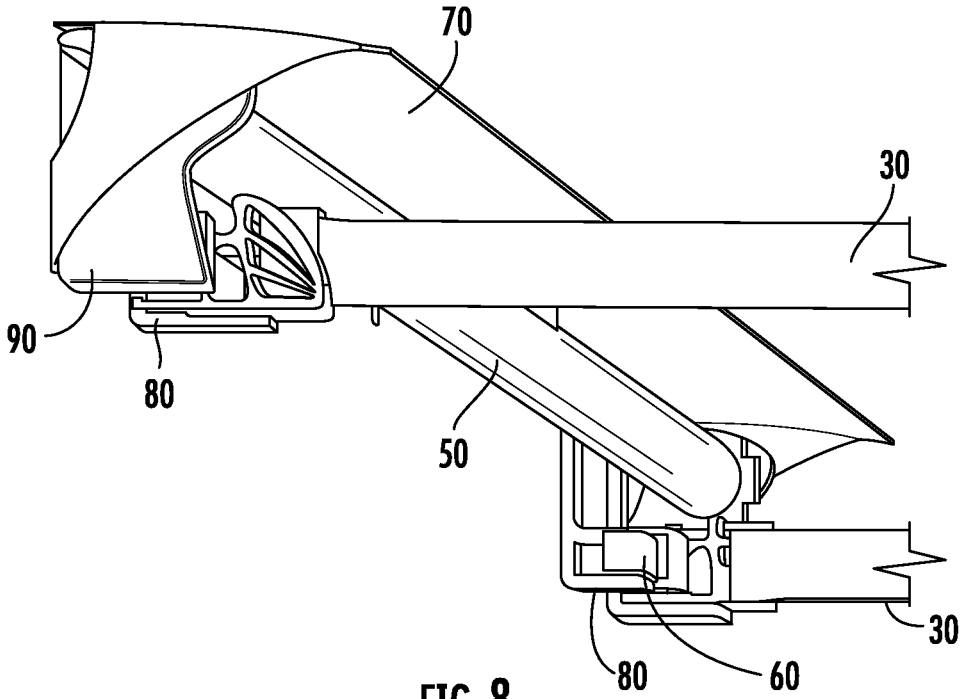
FIG. 8 is an enlarged bottom perspective view of a back end of the retractable awning assembly of FIG. 1.

Referring now to FIG. 8 (see also, e.g., FIG. 10A, FIG. 10B, FIG. 12B, FIG. 12N), as mentioned above, in some embodiments, the retractable awning assembly 100 may optionally include a hood 24. In some embodiments, the hood 24 may be formed from a plurality of hood sections 24*a*, 24*b*, 24*c* (see, e.g., FIG. 10B). For example, in some embodiments, the hood 24 may have one, two, three, or more hood sections 24*a*-24*c*. Each hood section 24*a*, 24*b*, 24*c* may be formed from sheet metal or other like material. The hood 24 is attached to the mounting brackets 22 and resides above the retractable awning 10. When the plurality of hood sections 24*a*, 24*b*, 24*c* are assembled together, the hood 24 may have a length in the range of about 10 feet to about 20 feet. For example, in some embodiments, the hood 24 has a length of about 16 feet.

Figure 12N:
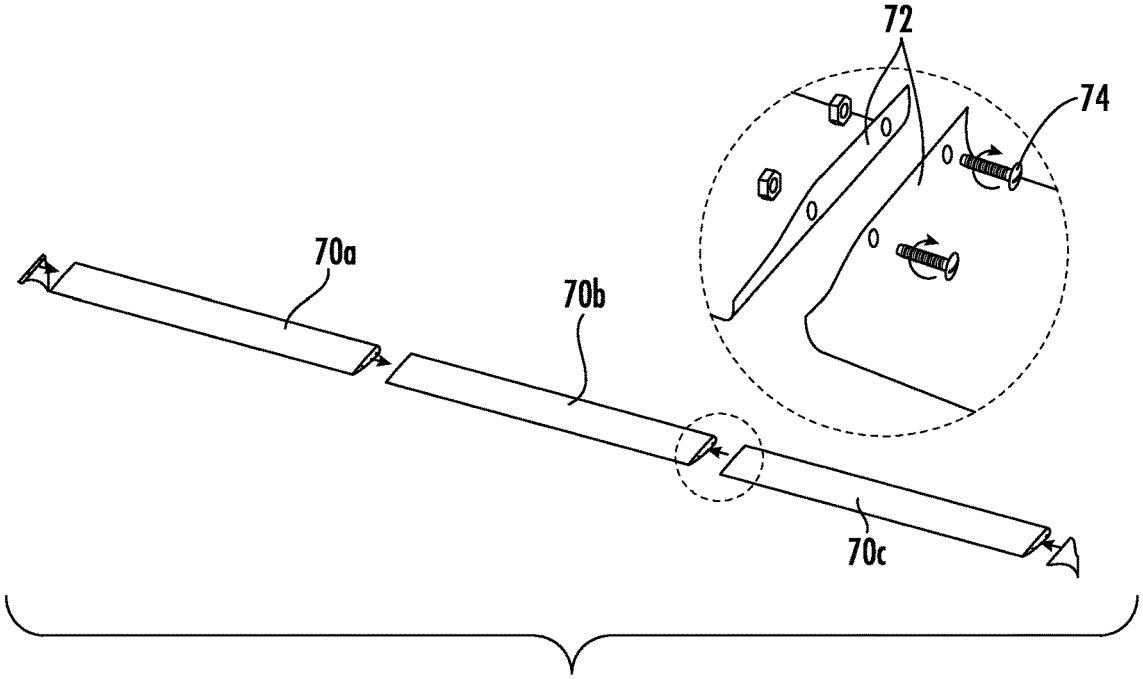
Figure 120:
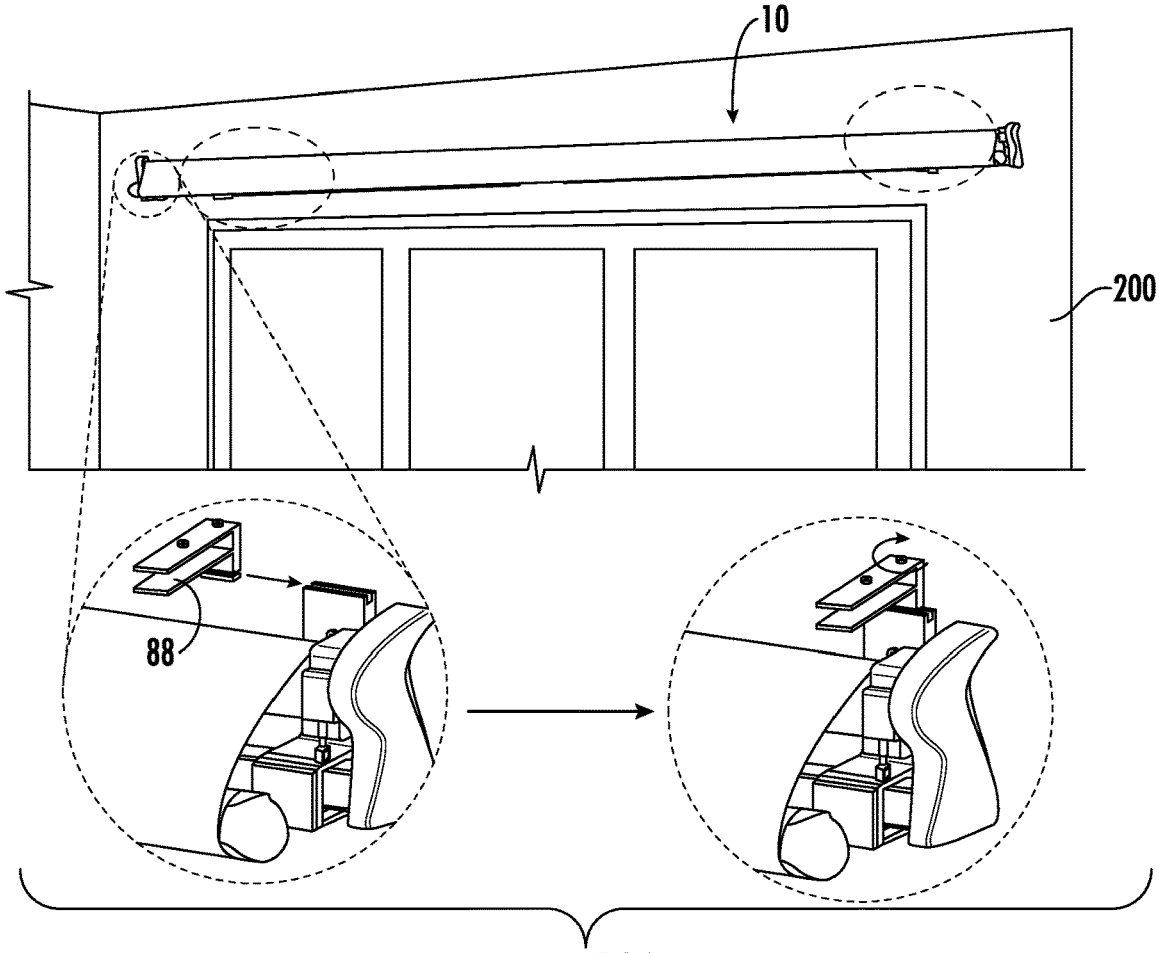

In some embodiments, each section of hood 24*a*, 24*b*, 24*c* may have a flange 72 bent at a 90 degree angle so that where the two hood sections 24*a*, 24*b*, 24*c* meet, the flanges 72 abut each other on the under face of the hood 24 (see, e.g., FIG. 12N). The hood sections 24*a*, 24*b*, 24*c* may then be secured together with a fastening mechanism 74 (e.g., screws, bolts, etc.) through the flanges 72. To ensure that the hood 24 stays watertight across the seam lines, a strip of rubber (not shown) may be used across the length of the flange 72 and the bolts tightened to compress the strip of rubber making a seal. Once the hood 24 has been assembled, it can be mounted above the retractable awning 10 on the mounting brackets 22. The hood 24 may further comprise lengthwise channels (not shown) to help support the hood 24 from excessive deflection due to self-weight. The hood 24 can protect the retractable awning 10 from exposure when not in use (i.e., retracted), for example, preventing hazardous accumulation of debris or ice.

Figure 9:
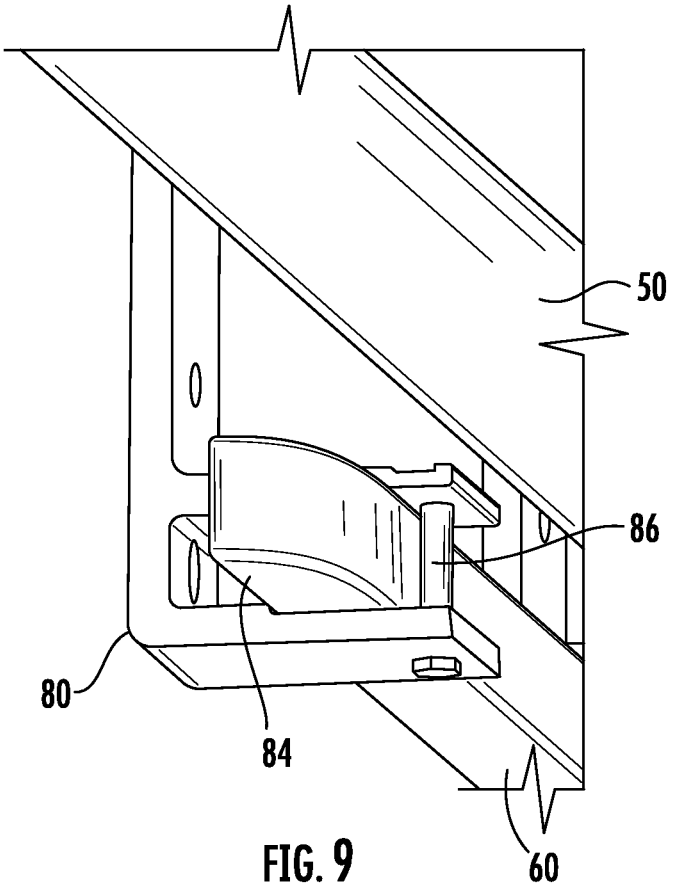
FIG. 9 is an enlarged bottom perspective view of a mounting bracket of the retractable awning assembly of FIG. 1.

In some embodiments, the retractable awning assembly 100 may further include a plurality of mounting brackets 22. FIG. 9 shows an enlarged bottom perspective view of a mounting bracket 22 according to embodiments of the present invention. The plurality of mounting brackets 22 are configured to secure the retractable awning 10 to a mounting structure 200 (e.g., an outside wall of a home) (see, e.g., FIGS. 12L-12Q). The mounting brackets 22 may comprise holes 82 through which the mounting brackets 22 may be bolted to the mounting structure 200. The mounting brackets 22 may each further comprise a slot 84 that is sized to fit the torsion bar sections 20. When each torsion bar section 20 has been inserted into the slots 84 of the mounting brackets 22, bolts 86 may be inserted to secure the torsion bar sections 20, and thus the retractable awning 10, in place.

Figure 12P:
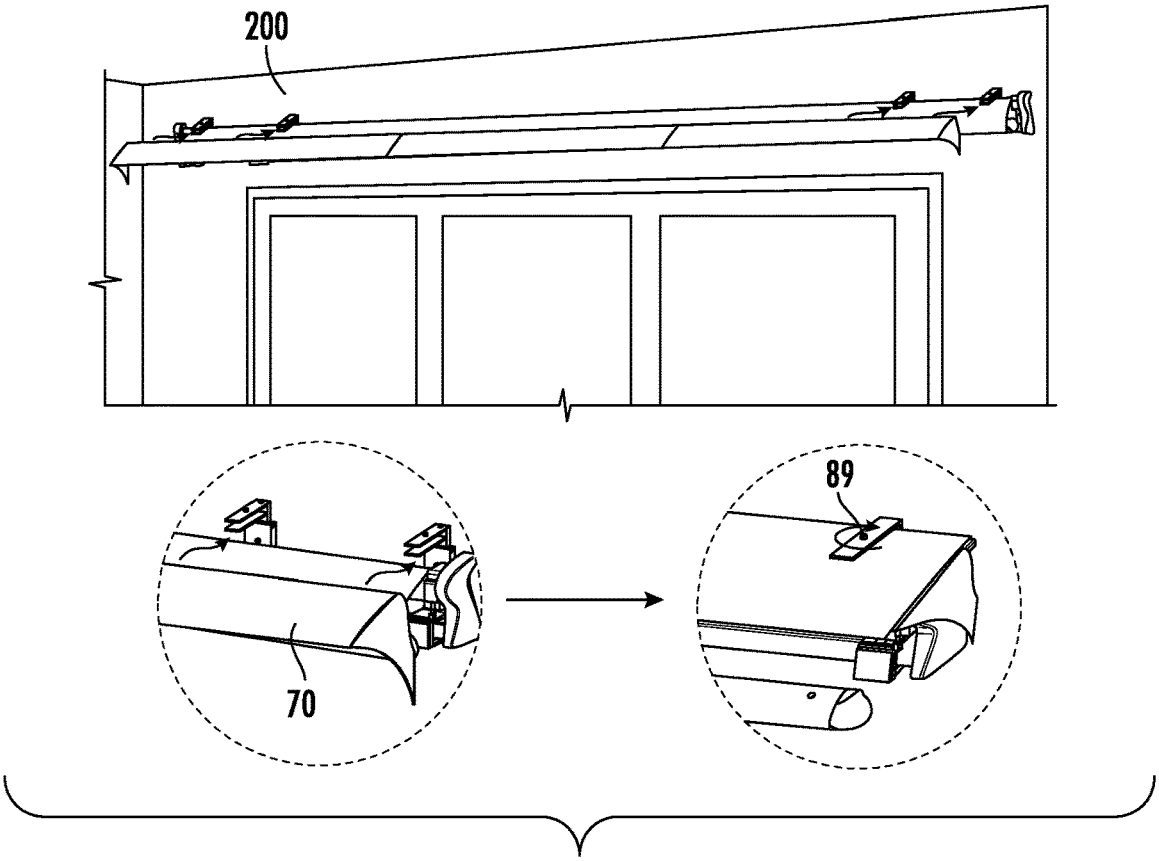
Figure 12Q:
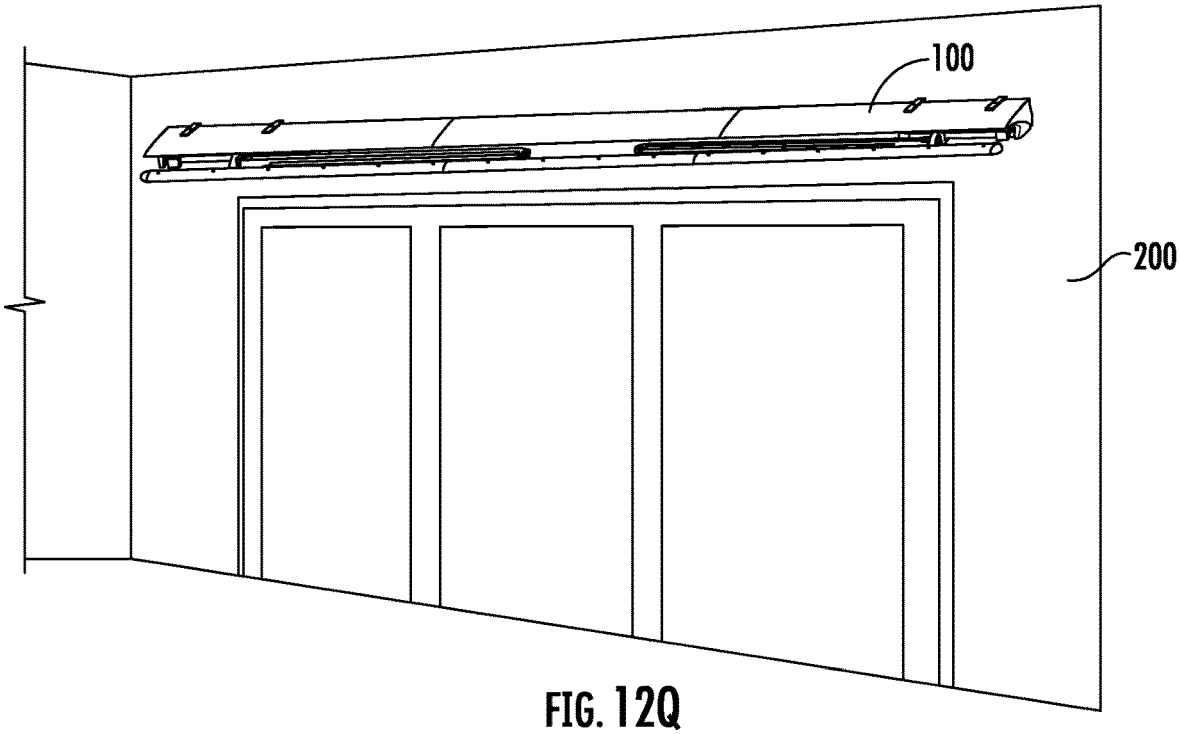

In some embodiments, the top of each mounting bracket 22 has a protruding support 88 configured to hold the hood 24. The hood 24 may be inserted to the support 88 (FIG. 12O). When fully inserted into each mounting bracket 22, the hood 24 has a lip (not shown) that is captured in each bracket 22 and helps prevent the hood 24 from sliding out of the mounting brackets 22. The hood 24 is fixed in place by securing bolts 89 (or other like fastening mechanism) tightened through the mounting bracket 22 from above creating a friction hold on the hood 24 (FIG. 12P).

Figure 11:
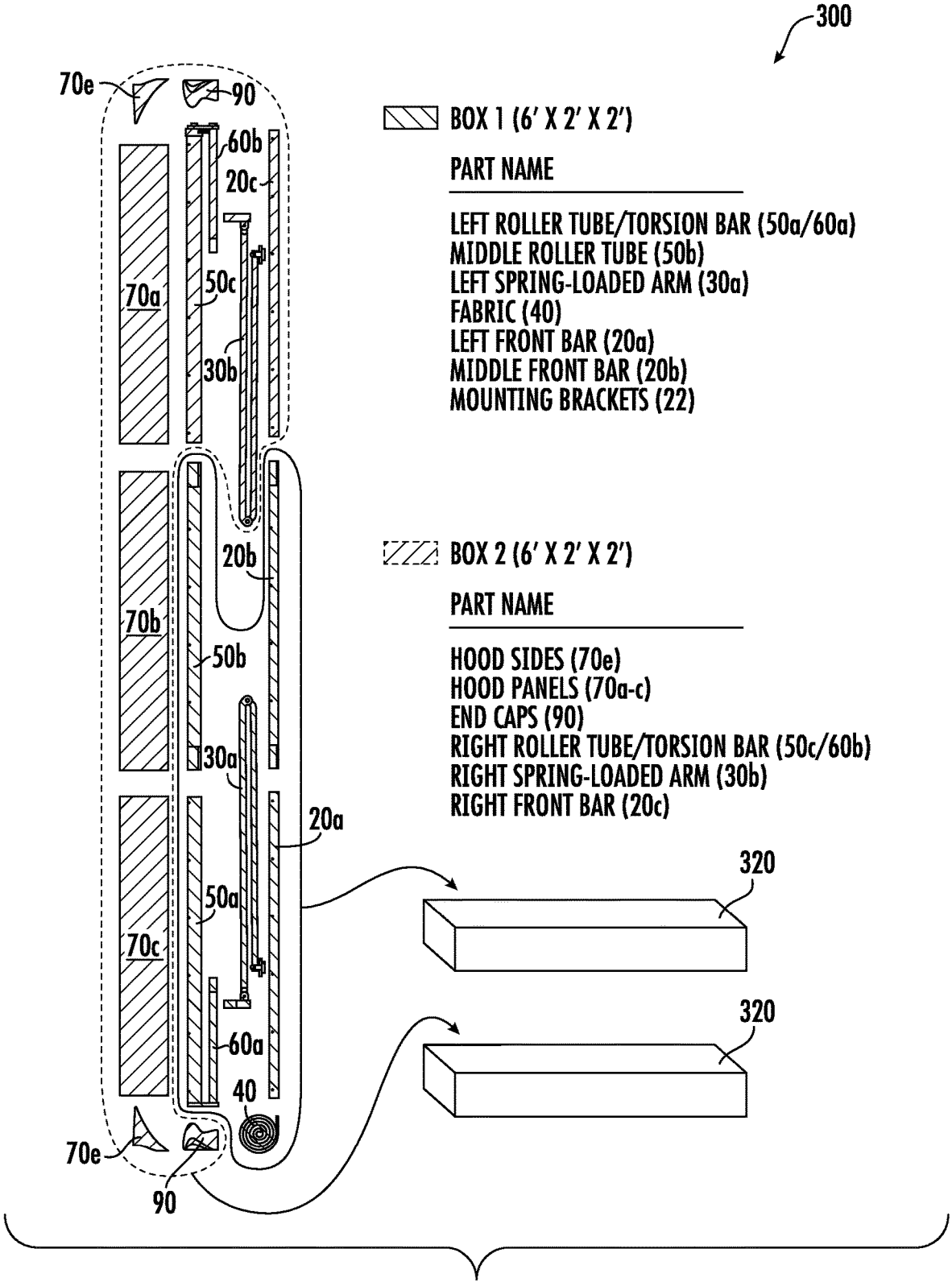
FIG. 11 illustrates an exemplary breakdown of components for packaging of a disassembled retractable awning assembly according to embodiments of the present invention.

Referring now to FIG. 11, according to embodiments of the present invention, an awning kit 300 is also provided. As shown in FIG. 11, the retractable awning 10, when disassembled, may have an awning kit 300 that can fit into four or fewer (typically three or fewer) packaging boxes 320. In some embodiments, each packaging box 320 may have a length in the range of about 5 feet to about 7 feet, a width in the range of about 1 foot to about 3 feet, and a height in the range of about 1 foot to about 3 feet. For example, in some embodiments, each packaging box 320 may have dimensions no greater than a length of about 6 feet, a width of about 2 feet, and a height of about 2 feet. FIG. 11 illustrates how the individual components of the retractable awning assembly 100 may be divided into the packaging boxes 320. In some embodiments, each packaging box 320 containing the disassembled retractable awning assembly 100 may weigh about 80 pounds or less. For example, in some embodiments, each packaging box 320 may weigh in a range of about 50 pounds to about 55 pounds. A retractable awning assembly 100 according to embodiments of the present invention having these parameters allows users to purchase and self-install the retractable awning assembly 100, thereby cutting down on the complication and cost of the transaction, and giving the owner more autonomy over the modification to their space.

Methods of assembling a retractable awning are also provided herein. As discussed above, FIGS. 12A-12Q illustrate steps for an exemplary method of assembling a retractable awning assembly 100 according to embodiments of the present invention. For example, in some embodiments, a method of assembly may include connecting a plurality of roller tube sections together by inserting keyed splices of one roller tube section into another roller tube section until a spring snap button feature secures each section together to form a roller tube subassembly, attaching and securing a pair of spring-loaded arms each to a respective torsion bar section, attaching the back end of a fabric cover to the roller tube subassembly (e.g., by inserting push-rivets into button holes pre-cut in the fabric cover and pre-drilled into each roller tube section), rolling the fabric cover onto roller tube, connecting a plurality of front bar sections together by inserting keyed splices of one front bar section into another front bar section until a spring snap button feature secures each section together to form a front bar subassembly; attaching and securing the spring-loaded arms to the front bar subassembly, attaching the front end of the fabric cover to the front bar subassembly (e.g., by inserting push-rivets into button holes pre-cut in the fabric cover and pre-drilled into each front bar section), securing a plurality of mounting brackets to a mounting structure, attaching and securing each of the at least two torsion bar sections to a respective mounting bracket, connecting and securing a plurality of hood sections together to form a hood, and attaching and securing the hood to each mounting bracket.

In some embodiments, a method of packaging a retractable awning assembly may comprise providing a disassembled retractable awning assembly comprising a roller tube having a plurality of roller tube sections, at least two torsion bar sections, each torsion bar section coupled to a respective roller tube section, a pair of spring-loaded arms, a fabric cover, a front bar having plurality of front bar sections, a pair of end caps, a plurality of mounting brackets, and a plurality of hood sections, wherein the retractable awning assembly, when assembled, has a length of between about 10 to 20 feet, typically between about 14 to 18 feet (e.g., about 16 feet), and placing the disassembled retractable awning assembly into four or fewer (often three or fewer) packaging boxes, each packaging box having dimensions no greater than a length of about 6 feet, a width of about 2 feet, and a height of about 2 feet.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A retractable awning assembly, comprising:

a retractable awning, comprising:

a roller tube having a plurality of roller tube sections, each roller tube section configured to be connected together by a first splicing feature that allow one roller tube section to be inserted into another roller tube section and configured to be secured to one another by a first locking mechanism;

two torsion bar sections, each torsion bar section attached to a respective roller tube section, wherein each torsion bar section has a length in the range of about 10 inches to about 30 inches, and wherein a gap resides between the two torsion bar sections;

a pair of spring-loaded arms, each spring-loaded arm attached to a respective torsion bar section;

a front bar having a plurality of front bar sections, each front bar section is configured to be mounted together by a second splicing feature that allow one front bar section to be inserted into another front bar section and configured to be secured to one another by a second locking mechanism, the front bar is attached to the pair of spring-loaded arms; and a fabric cover having a front end and a back end, wherein the front end of the fabric cover is attached to the front bar and the back end of the fabric cover is attached to the roller tube;

a plurality of mounting brackets configured to secure the retractable awning to a mounting structure, wherein two of the mounting brackets reside on opposing ends of each torsion bar section; and a hood having a plurality of hood sections, the hood attached to the plurality of mounting brackets and residing above the retractable awning.

2. The retractable awing assembly of claim 1, wherein the first and second splicing features are keyed splices.

3. The retractable awing assembly of claim 1, wherein the first and second locking mechanisms are spring snap button features.

4. The retractable awning assembly of claim 1, wherein the fabric cover curves over a front edge of the front bar and is attached to a bottom side of the front bar with push-rivets.

5. The retractable awning assembly of claim 1, wherein the retractable awning assembly, when disassembled, fits into four or fewer packaging boxes, each packaging box having dimensions no larger than a length of about 6 feet, a width of about 2 feet, and a height of about 2 feet.

6. The retractable awning assembly of claim 1, wherein the roller tube, torsion bar sections, spring-loaded arms, and front bar each comprise aluminum, aluminum alloy, steel or carbon fiber-reinforced polymer.

7. The retractable awning assembly of claim 1, wherein the plurality of roller tube sections comprises three disassembled roller tube sections, the plurality of front bar sections comprises three disassembled front bar sections and the plurality of hood sections comprises three disassembled hood sections.

8. A retractable awning assembly, comprising:

a retractable awning, comprising:

a roller tube having a plurality of roller tube sections, each roller tube section configured to be connected together by a first splicing feature that allow one roller tube section to be inserted into another roller tube section and configured to be secured to one another by a first locking mechanism;

two torsion bar sections, each torsion bar section attached to a respective roller tube section without being secured to one another;

a pair of spring-loaded arms, each spring-loaded arm attached to a respective torsion bar section;

a front bar having a plurality of front bar sections, each front bar section is configured to be mounted together by a second splicing feature that allow one front bar section to be inserted into another front bar section and configured to be secured to one another by a second locking mechanism, the front bar is attached to the pair of spring-loaded arms; and a fabric cover having a front end and a back end, wherein the front end of the fabric cover is attached to the front bar and the back end of the fabric cover is attached to the roller tube;

a plurality of mounting brackets configured to secure the retractable awning to a mounting structure, wherein two of the mounting brackets reside on opposing ends of each torsion bar section; and a hood having a plurality of hood sections, the hood attached to the plurality of mounting brackets and residing above the retractable awning, wherein the roller tube, front bar and hood each comprise three disassembled sections, wherein the retractable awning assembly, when disassembled, fits into four or fewer packaging boxes, each packaging box having dimensions no larger than a length of about 6 feet, a width of about 2 feet, and a height of about 2 feet, and wherein each packaging box, in combination with a disassembled retractable awning, weighs about 80 pounds or less.

9. A retractable awning assembly, comprising:

a retractable awning, comprising:

a roller tube having a plurality of roller tube sections, each roller tube section configured to be connected together by a first splicing feature that allow one roller tube section to be inserted into another roller tube section and configured to be secured to one another by a first locking mechanism;

two torsion bar sections, each torsion bar section attached to a respective roller tube section, wherein a gap resides between the two torsion bar sections;

a pair of spring-loaded arms, each spring-loaded arm attached to a respective torsion bar section;

a front bar having a plurality of front bar sections, each front bar section is configured to be mounted together by a second splicing feature that allow one front bar section to be inserted into another front bar section and configured to be secured to one another by a second locking mechanism, the front bar is attached to the pair of spring-loaded arms; and a fabric cover having a front end and a back end, wherein the front end of the fabric cover is attached to the front bar and the back end of the fabric cover is attached to the roller tube;

a plurality of mounting brackets configured to secure the retractable awning to a mounting structure, wherein two of the mounting brackets reside on opposing ends of each torsion bar section; and a hood having a plurality of hood sections, the hood attached to the plurality of mounting brackets and residing above the retractable awning.

* * * * *